United States Patent [19]

Inoue et al.

[11] Patent Number: 4,801,520

[45] Date of Patent: Jan. 31, 1989

[54] DIRECT POSITIVE COLOR LIGHT-SENSITIVE MATERIAL COMPRISING A DIR COUPLER AND A PYRAZOLOAZOLE COUPLER, AND A PROCESS FOR FORMING A DIRECT POSITIVE IMAGE

[75] Inventors: Noriyuki Inoue; Tatsuo Heki, both of Kanagawa, Japan

[73] Assignee: Fuji Photo Film Co., Ltd., Kanagawa, Japan

[21] Appl. No.: 75,008

[22] Filed: Jul. 17, 1987

[30] Foreign Application Priority Data

Jul. 18, 1986 [JP] Japan ..... 61-169523

[51] Int. Cl.[4] ..... G03C 7/00; G03C 1/485

[52] U.S. Cl. ..... 430/378; 430/226; 430/382; 430/505; 430/547; 430/544; 430/558; 430/598; 430/957

[58] Field of Search ..... 430/226, 378, 382, 505, 430/547, 544, 598, 957, 558

[56] References Cited

U.S. PATENT DOCUMENTS

| | | | |
|---|---|---|---|
| 3,933,500 | 1/1976 | Shiba et al. | 430/504 |
| 4,187,110 | 2/1980 | Yagihara et al. | 430/544 |
| 4,431,728 | 2/1984 | Abe et al. | 430/544 |
| 4,444,871 | 4/1984 | Miyaoka et al. | 430/378 |
| 4,477,563 | 10/1984 | Ichijima et al. | 430/544 |
| 4,581,328 | 4/1986 | Matsuyama | 430/567 |

FOREIGN PATENT DOCUMENTS

| | | | |
|---|---|---|---|
| 0086654 | 8/1983 | European Pat. Off. | 430/957 |
| 2655870 | 12/1975 | Fed. Rep. of Germany | 430/598 |
| 206834 | 7/1984 | Japan . | |
| 210440 | 9/1984 | Japan . | |
| 92556 | 3/1986 | Japan . | |
| 1170733 | 8/1986 | Japan | 430/598 |
| 3249 | 1/1987 | Japan . | |
| 1151363 | 5/1969 | United Kingdom . | |
| 1504094 | 6/1985 | United Kingdom . | |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A direct positive color light-sensitive material comprising a support having provided thereon at least one photographic emulsion layer containing unfogged internal latent image type silver halide particles and a color image forming coupler, wherein said color image forming coupler itself is substantially nondiffusible and produces or releases a dye upon oxidation coupling with a color developing agent, and said light-sensitive material contains at least one development inhibitor-releasing type coupler selected from the group consisting of compounds represented by formulae (D-I) and (D-II)

Coup—Z (D-I)

Coup—TIME—Z (D-II)

wherein Coup represents a coupler residual group; Z represents a diffusible development inhibitor or a precursor thereof; and TIME represents a timing group.

18 Claims, No Drawings

DIRECT POSITIVE COLOR LIGHT-SENSITIVE MATERIAL COMPRISING A DIR COUPLER AND A PYRAZOLOAZOLE COUPLER, AND A PROCESS FOR FORMING A DIRECT POSITIVE IMAGE

FIELD OF THE INVENTION

The present invention relates to a direct positive color silver halide photographic material which can provide a direct positive color image in a processing step in which it is imagewise exposed to light, and then color-developed after or while being fogged.

BACKGROUND OF THE INVENTION

Photographic processes for obtaining a direct positive image without the necessity of a reversal processing step or negative film are well known.

Processes for forming a positive image on a direct positive silver halide photographic material which have been heretofore known can be roughly divided into two types.

In one of the two types of processes, a silver halide emulsion which has previously been fogged is used. Solarization or the Herschel effect is used to destroy the fogged nuclei (latent image) in the exposed portions so that a direct positive image is obtained after development.

In the other type, a internal latent image type silver halide emulsion which has not previously been fogged is used. After being imagewise exposed to light, the emulsion is surface-developed after or while being light-fogged so that a direct positive image is obtained.

The term "internal latent image type silver halide photographic emulsion" as used herein means a silver halide photographic emulsion of the type which contains light-sensitive nuclei mainly in the inside of silver halide particles so that a latent image is formed mainly in the inside of the particles upon exposure to light.

The latter type of process generally provides a higher sensitivity than the former does and is thus suitable for high sensitivity applications. The present invention relates to the latter type of process.

In this art, various methods have heretofore been known. Examples of such methods are described in U.S. Pat. Nos. 2,592,250, 2,466,957, 2,497,875, 2,588,982, 3,317,322, 2,497,875, 3,761,266, 3,761,276, and 3,796,577, and British Patent Nos. 1,151,363, 1,150,553, and 1,011,062.

With these known methods, a relatively high sensitive photographic light-sensitive of direct positive type can be prepared.

Details of the formation mechanism of a direct positive image are described in, for example, "The Theory of The Photographic Process" (edited by T. H. James, Vol. 4, pp. 183 to 193, Chapter 7), and U.S. Pat. No. 3,761,276.

According to the theory set forth in the above publications, the first imagewise exposure to light produces a so-called internal image in the inside of the silver halide which causes a reduction in the sensitivity of the surface thereof. This in turn causes a selective production of fogged nuclei only on the surface of unexposed silver halide particles. When the light-sensitive material is then subjected to ordinary so-called surface development, a photographic image (direct positive image) is formed on the unexposed portions.

Two fogging processes for selective production of fogged nuclei are known: (1) A process commonly referred to as the "light fogging process" in which the entire surface of a light-sensitive material is subjected to a second exposure to light (as described in British Pat. No. 1,151,363) and (2) a process commonly referred to as the "chemical fogging process" in which a nucleating agent is used. The latter process is described in Research Disclosure No. 15162 (Vol. 151, November, 1976, pp. 72 to 87).

In accordance with the chemical fogging process, the formation of a direct positive color image can be accomplished by a process which comprises subjecting an internal latent image type silver halide photographic material to surface color development after or while subjecting it to fogging, and then subjecting it to bleach and fixing (or blix). The bleach and fixing step is generally followed by rinsing and/or a stabilizing step.

However, the above process has the disadvantage that the light-sensitive material is sensitive to temperature and pH fluctuation of the developing solution during the process or the like in the presence of a nucleating agent. This causes fluctuation in maximum image density. This in turn causes fluctuation in color reproducibility.

On the other hand, the light fogging process does not require as high a pH as the chemical fogging process does. Therefore, the light fogging process has an advantage over the chemical fogging process. However, the light fogging process is as much subject to temperature and pH fluctuation of the developing solution as the chemical fogging process. Accordingly, it is difficult to obtain consistent results with the light fogging process.

U.S. Pat. No. 3,708,298 refers to the incorporation of a fog inhibitor such as triazoline-thione and tetrazoline-thione compounds in a light-sensitive material on which a direct positive image is to be formed in a light fogging process. However, this process is not able to attain high maximum image density, high image speed, and constant image stability.

Thus, no methods have heretofore been known for providing a stable direct positive color image having high maximum color image density and low minimum image density with a low pH (i.e., less than 12) stable developing solution in a short processing time.

Another disadvantage with these methods is that the higher the sensitivity of the direct positive emulsion, the more re-reversal negative images are produced at high intensity exposure.

SUMMARY OF THE INVENTION

It is therefore an object of the present invention to provide a light-sensitive material and process for forming a stable direct positive color image having a high maximum color density and a low minimum image density in a short period of time by processing an unfogged internal latent image type silver halide photographic material with a low pH color developing solution.

It is another object of the present invention to provide a light-sensitive material and process for forming a direct positive color image which is less subject to fluctuation in maximum image density and minimum image density from optimum value and fluctuation in color reproducibility due to fluctuation in the temperature and pH of the color developing solution.

It is a further object of the present invention to provide a light-sensitive material and process for forming a direct positive color image which is less subject to fluctuation in maximum image density and minimum image density from optimum value and fluctuation in color reproducibility due to fluctuations in color development time from a standard value.

It is a further object of the present invention to provide a light-sensitive material and process for forming a direct positive color image which is less subject to reduction in maximum image density and rise in minimum image density after being stored for a prolonged period of time.

It is a further object of the present invention to provide a light-sensitive material and process for forming a direct positive color image which is less subject to production of re-reversal negative images at high intensity exposure.

It is a further object of the present invention to provide a process for the formation of a stable direct positive color image which causes less deterioration of the developing solution due to air oxidation.

It is a further object of the present invention to provide a process for the formation of a direct positive color image having a high saturation.

These and other objects of the present invention will become more apparent from the following detailed description and examples.

These objects of the present invention are accomplished by the use of a development inhibitor-releasing type coupler described below.

Such development inhibitor-releasing type couplers have heretofore been put into practical use in color photographic film with excellent color reproducibility (high image sharpness). Such couplers have been proposed for use in color print photographic paper (color paper) (see Japanese Patent Application (OPI) Nos. 72240/86, 80250/86, 80251/86, and 80252/86 (the term "OPI" as used herein refers to a "published unexamined Japanese patent application").) However, all the suggestions therein relate to negative emulsions for forming a latent image mainly on the surface of silver halide particles. None of these suggestings contains a teaching that the above mentioned problems inherent to internal latent image type direct positive emulsions for forming a latent image mainly in the inside of silver halide particles can be solved by such development inhibitor-releasing type couplers.

In accordance with the present invention, a direct positive color light-sensitive material is provided comprising a support having provided thereon at least one photographic emulsion layer containing an unfogged internal latent image type silver halide particles and a color image forming coupler, wherein the color forming coupler itself is substantially nondiffusible and produces or releases a preferably nondiffusible dye upon oxidation coupling with a color developing agent, and the light-sensitive material contains at least one development inhibitor-releasing type coupler selected from the group of compounds represented by formulae (D-I) and (D-II)

Coup—Z (D-I)

Coup—TIME—Z (D-II)

wherein Coup represents a coupler residual group; Z represents a diffusible development inhibitor or precursor thereof; and TIME represents a timing group.

DETAILED DESCRIPTION OF THE INVENTION

The term "development inhibitor releasing type coupler" as used herein means a compound which releases a development inhibiting substance or its precursor upon reaction with an oxidation product of a developing agent (herein referred to as "DIR compound"). Such a DIR compound is represented by formula (D-I) or (D-II)

Coup—Z (D-I)

Coup—TIME—Z (D-II)

wherein Coup represents a coupler residual group; Z represents a diffusible development inhibitor or its precursor; and TIME represents a timing group.

Examples of such a coupler residual group which may be used in the present invention include residual groups of any suitable couplers which are used as image forming couplers or colorless couplers (portion obtained by removing a coupling-off group from a coupler).

Examples of the yellow coupler residual group include pivaloylacetoanilide type, benzoylacetoanilide type, malondiester type, malondiamide type, dibenzoylmetane type, benzothiazolylacetamide type, malonester monoamide type, benzothiazolylacetate type, benzoxazolylacetamide type, benzoxazolylacetate type, benzimidazolylacetamide type, or benzimidazolylacetate type coupler residual groups; a coupler residual group derived from a heterocyclic group-substituted acetamide or a heterocyclic group-substituted acetate described in U.S. Pat. No. 3,841,880; a coupler residual group derived from a acylacetamido described in U.S. Pat. No. 3,770,446, British Pat. No. 1,459,171, West German Patent Application (OLS) No. 2,503,099, Japanese Patent Application (OPI) No. 139738/75, and *Research Disclosure* RD-No. 15737; and a heterocyclic type coupler residual group described in U.S. Pat. No. 4,046,574.

Examples of the magenta coupler residual group include a coupler residual group containing 5-oxo-2-pyrazoline nucleus, pyrazolo-(1,5-a)benzimidazole nucleus, or a cyanoacetophenone type coupler residual group.

Examples of the cyan coupler residual group include a coupler residual group containing phenol nucleus or 60 -naphthol nucleus.

Specific examples of such a TIME group include groups capable of coupling-off by an intramolecular nucleophilic substitution reaction as described in Japanese Patent Application (OPI) Nos. 145135/79 and 56837/82 and U.S. Pat. No. 4,248,962; groups capable of coupling-off by the transfer of electrons along a conjugated chain as described in Japanese Patent Application (OPI) Nos. 188035/82 and 154234/82 and British Pat. No. 2,072,363; oxymethylene groups described in U.S. Pat. No. 4,146,396; and oxycarbonyloxy group described in Japanese Patent Application (OPI) No. 146828/76.

As Z group there may be used a common development inhibitor. Preferred examples of such a development inhibitor include mercaptotetrazole, selenotetrazole, mercaptobenzothiazole, selenobenzothiazole, mercaptobenzoxazole, selenobenzoxazole, mercaptobenzimidazole, selenobenzimidazole, benzotriazole, benzodiazole, and derivatives or precursors thereof.

Hydrolysis type DIR couplers are preferably used, especially when the replenishment amount of a developing solution is small. Useful examples of such DIR couplers include those described in U.S. Pat. No. 4,477,563, British Pat. No. 2,099,167B, and Japanese Patent Application (OPI) No. 205150/83.

Specific examples of DIR couplers, represented by formulae (D-I) and (D-II), will be shown hereinafter, but the present invention should not be construed as being limited thereto.

(D-I-1)

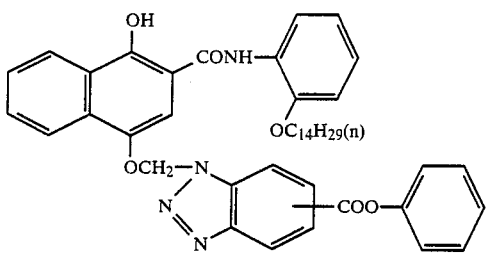

(D-I-2)

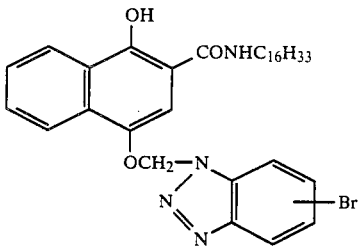

(D-I-3)

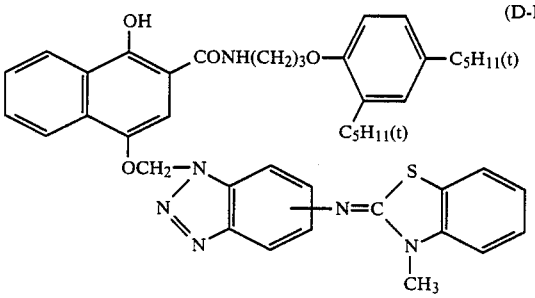

(D-I-4)

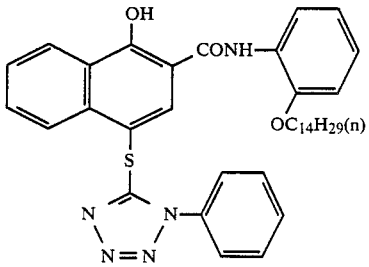

(D-I-5)

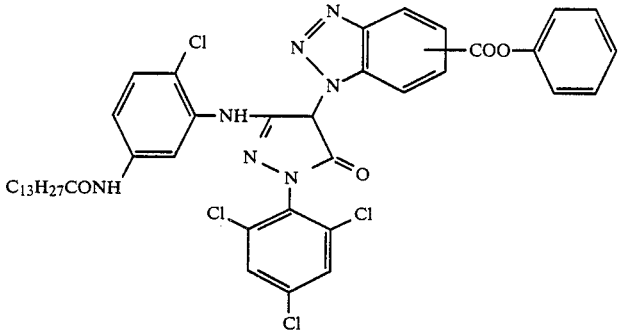

(D-I-6)

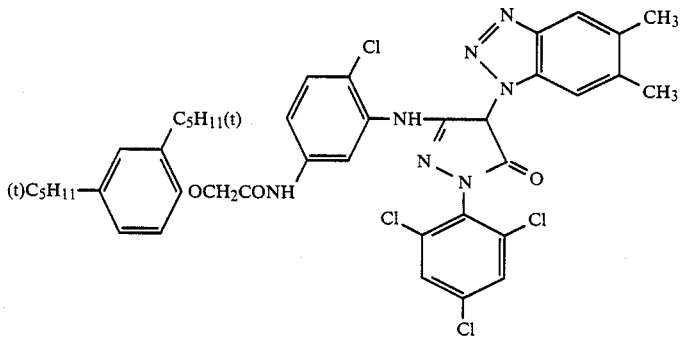

-continued
(D-I-7)
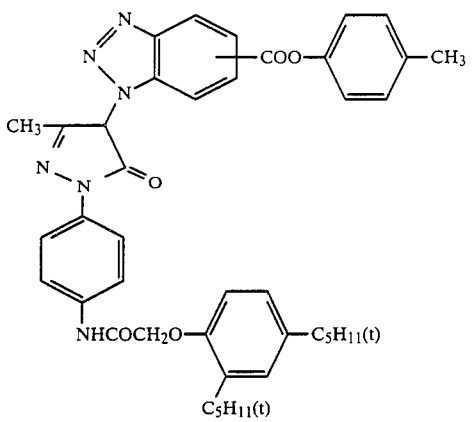
(D-I-8)
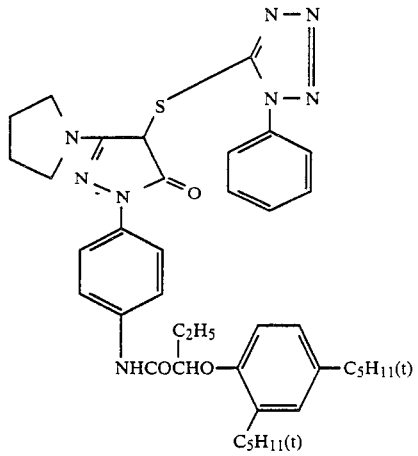
(D-I-9)
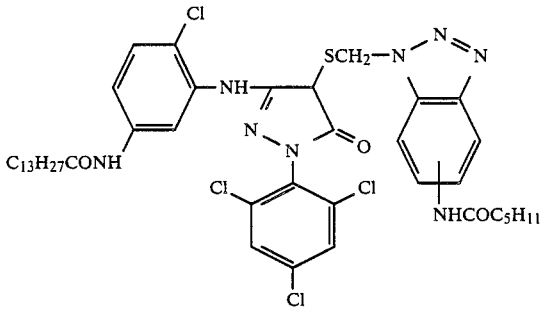
(D-I-10)
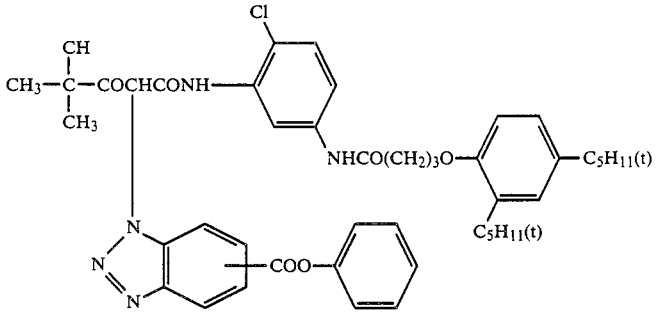
(D-I-11)
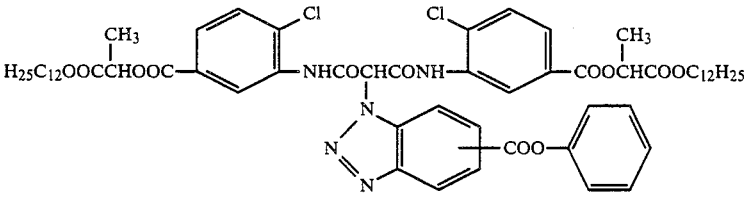
(D-I-12)
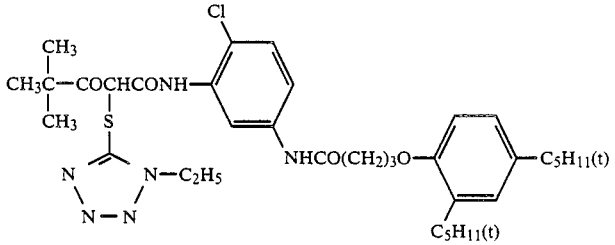

-continued
(D-I-13)
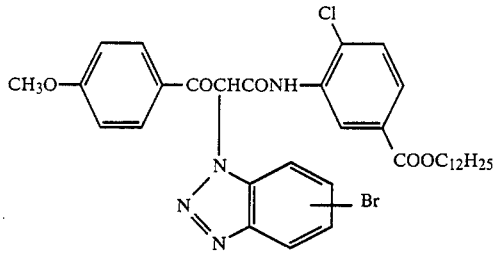
(D-I-14)
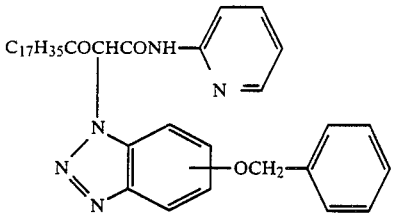
(D-I-15)
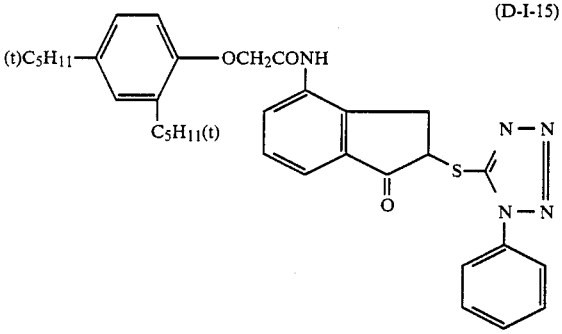
(D-I-16)
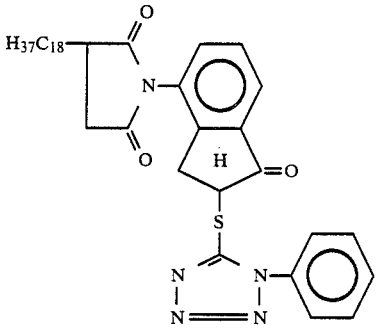
(D-I-17)
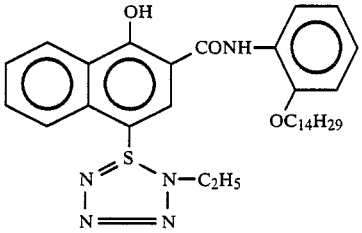
(D-I-18)
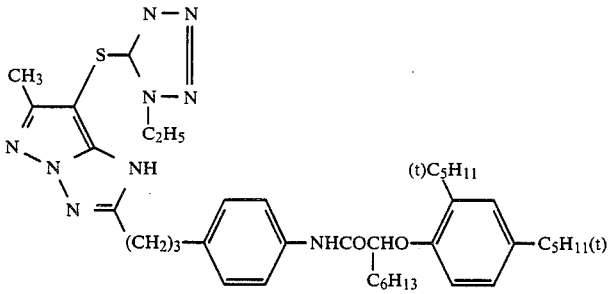
(D-I-19)
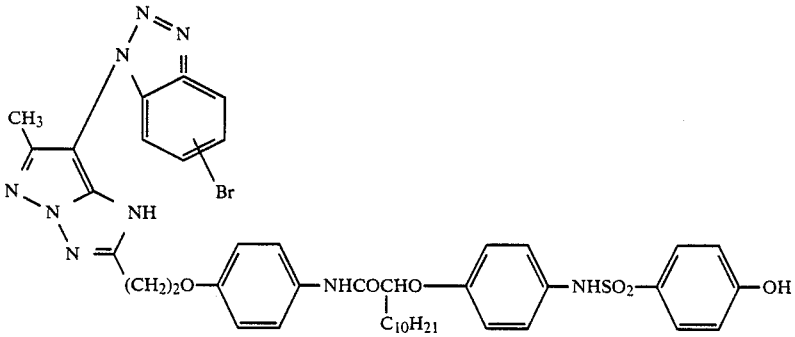

-continued
(D-I-20)
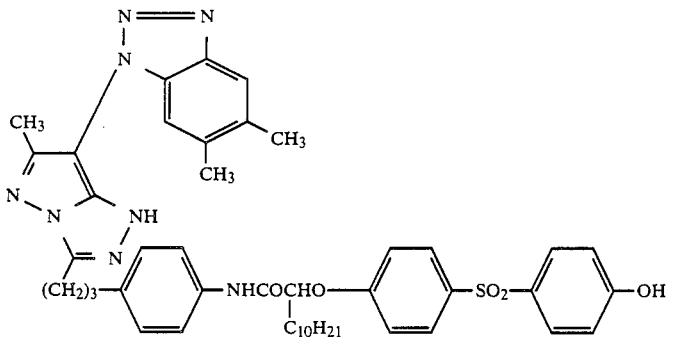
(D-I-21)
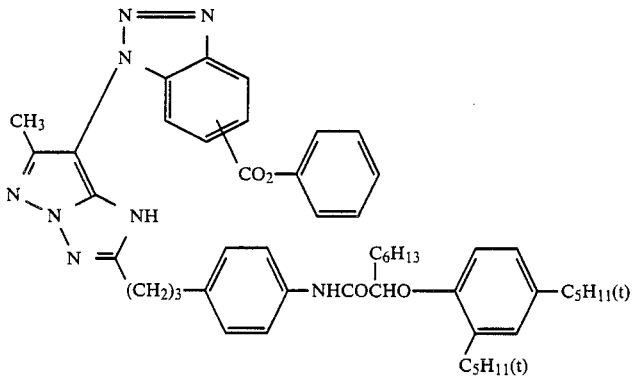
(D-I-22)
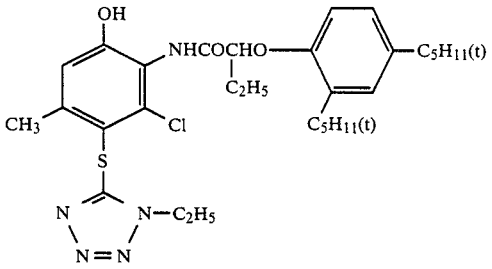
(D-I-23)
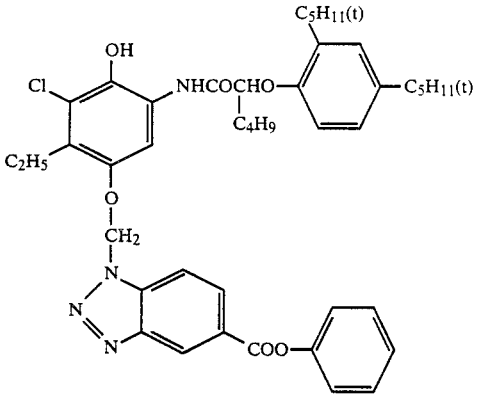
(D-I-24)
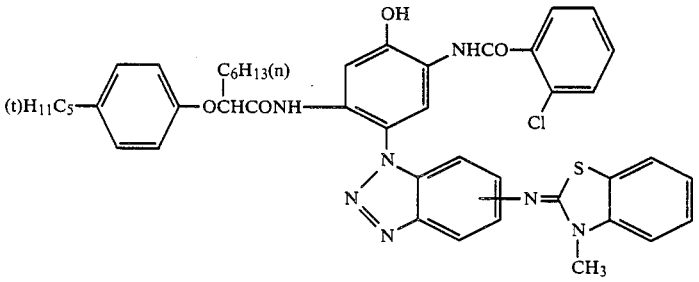

-continued
(D-II-1)
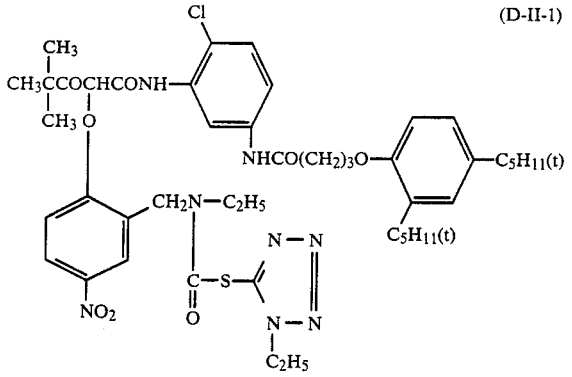
(D-II-2)
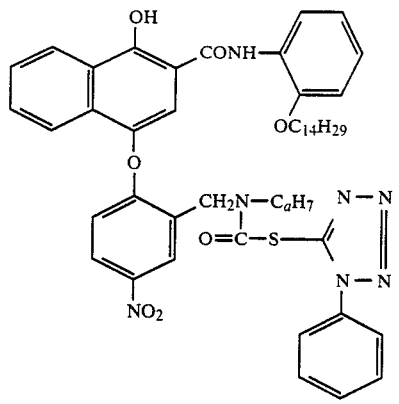
(D-II-3)
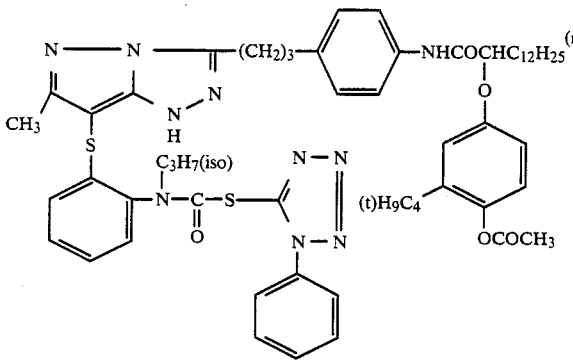
(D-II-4)
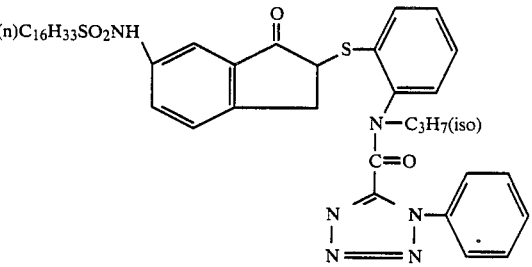
(D-II-5)
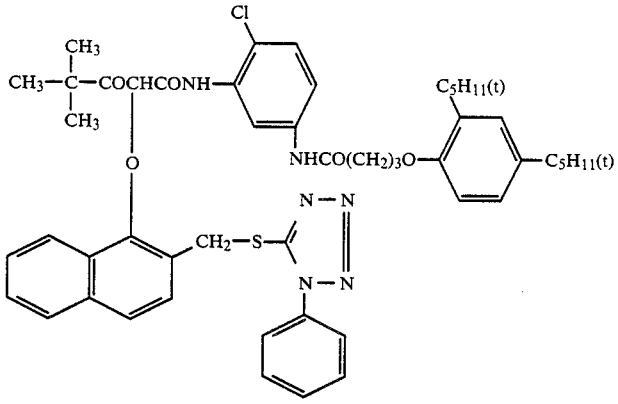
(D-II-6)
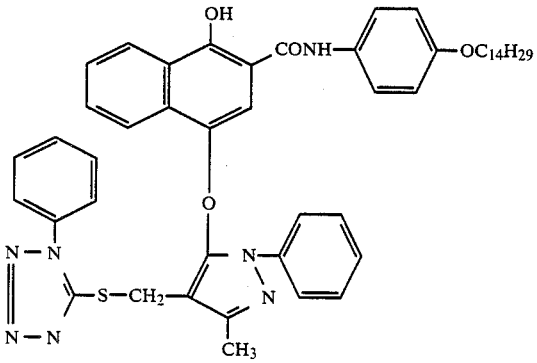
(D-II-7)
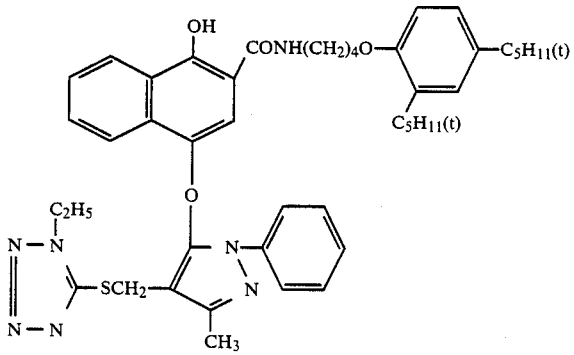

-continued
(D-II-8)
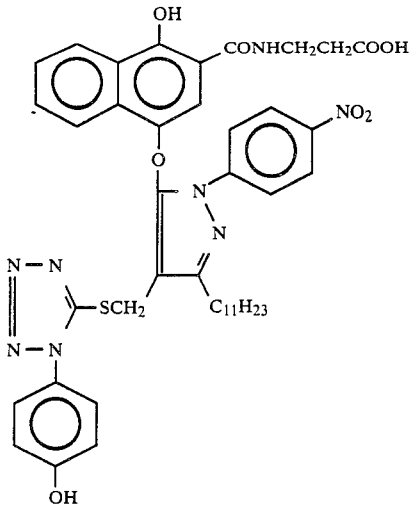
(D-II-9)
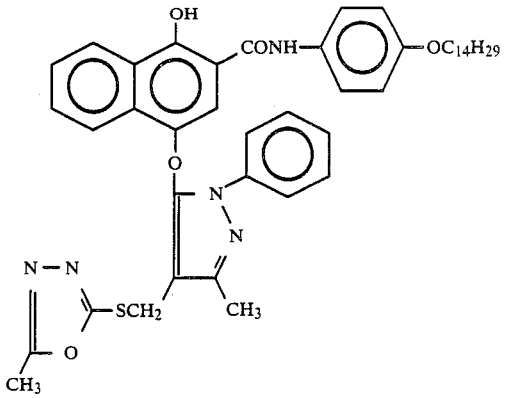
(D-II-10)
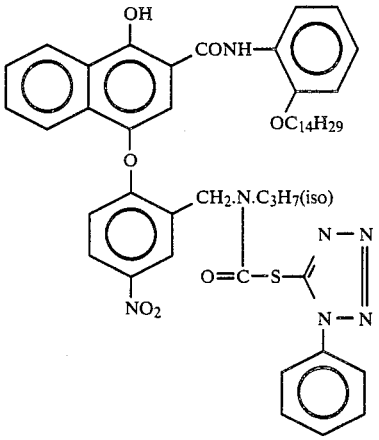
(D-II-11)
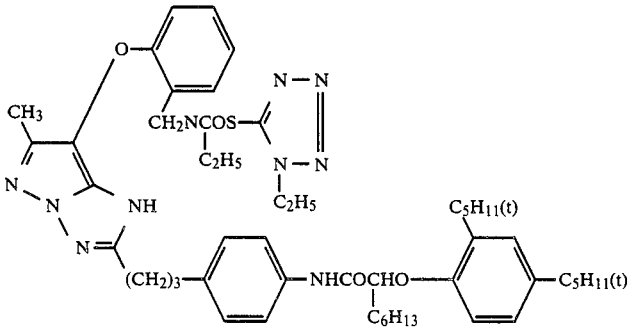

-continued (D-II-12)

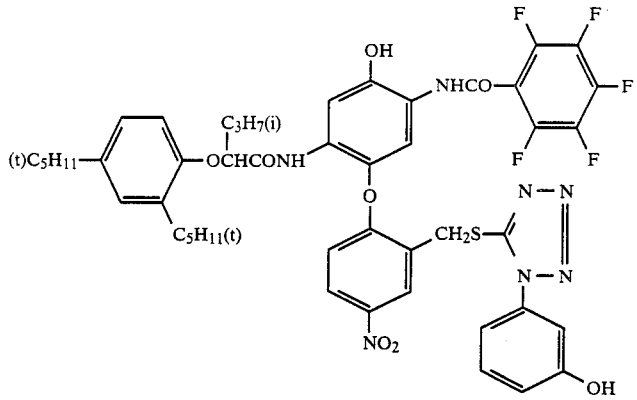

(D-II-13)

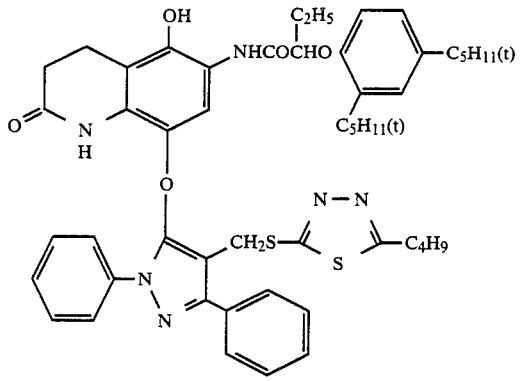

(D-II-14)

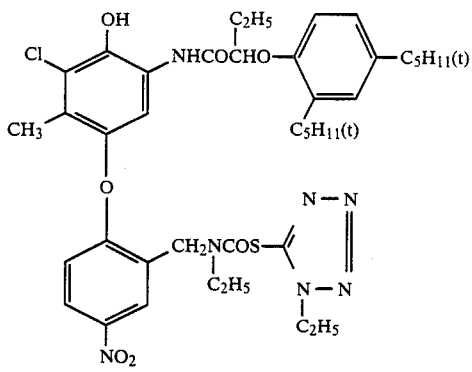

Among the above mentioned compounds, Compounds (D-I-1), (D-I-5), (D-I-10), (D-I-11), (D-II-6), (D-II-8), (D-II-9), and (D-II-10) are particularly preferable.

The compound which releases a development inhibiting substance or its precursor which may be used in the present invention is not specifically limited. If the development inhibiting effect of the development inhibiting substance thus released is weak, the rate of coupling of the coupler with an oxidation product of a developing agent is low, or the coupler contains a low timing group, the objects of he present invention can be accomplished by increasing amount of the DIR compound added.

The synthesis of these DIR compounds can be accomplished with common existing compounds using methods as described in Japanese Patent Application No. 131934/84, and Japanese Patent Application (OPI) Nos. 154631/77, 70821/78, 73033/79, 145135/79, and 188035/82.

These DIR compounds may be incorporated in either the silver halide emulsion layer or the light-insensitive intermediate layer to accomplish the objects of the present invention.

The amount of the present DIR compound to be used in generally in the range of from $1\times10^{-6}$ to $1\times10^{-1}$ mol, preferably from $5\times10^{-5}$ to $5\times10^{-2}$ mol per 1 mol of silver halide.

The unfogged internal latent image type silver halide emulsion to be used in the present invention is an emulsion of silver halide particles which have not previously been fogged on the surface thereof and which forms a latent image mainly in the particles. More particularly, such an unfogged internal latent image type silver halide emulsion shows a maximum density at least five times, preferably at least 10 times when developed with the developing solution A (internal type developing solution) described below at a temperature of 18° C. for 5 minutes than when developed with the developing solution B (surface type developing solution) described below at a temperature of 20° C. for 6 minutes. For the measurement of the maximum density, the emulsion is coated on a transparent support in an amount of from 0.5 to 3 g Ag per $m^2$. The coated emulsion is then exposed to light for a fixed period of time ranging from 0.01 to 10 seconds. The measurement is effected in an ordinary photographic density measuring method.

| Developing Solution B | |
|---|---|
| N—Methyl-p-aminophenol sulfate | 2.5 g |
| l-Ascorbic acid | 10 g |
| $NaBO_2.H_2O$ | 35 g |
| KBr | 1 g |
| Water to make | 1 l |
| **Developing Solution A** | |
| N—Methyl-p-aminophenol sulfate | 2 g |
| Sodium sulfite (anhydride) | 90 g |
| Hydroquinone | 5 g |
| Sodium carbonate (monohydrate) | 52.5 g |
| KBr | 5 g |
| KI | 1 g |
| Water to make | 1 l |

Specific examples of such an internal latent image type emulsion include conversion type silver halide emulsions as described in British Pat. No. 1,011,062, and U.S. Pat. Nos. 2,592,250 and 2,456,943, and core/shell type silver halide emulsions as described in Japanese Patent Application (OPI) Nos. 32813/72, 32814/72, 134721/77, 156614/77, 60222/78, 66218/78, 66727/78, 127549/80, 136641/82, 70221/83, 208540/84, 216136/84, 107641/85, 247237/85, 2148/86, and 3137/86, Japanese Patent Publication Nos. 18939/81, 1412/83, 1415/83, 6935/83, and 108528/83, Japanese Patent Application No. 36424/86, U.S. Pat. Nos. 3,206,313, 3,317,322, 3,761,266, 3,761,276, 3,850,637, 3,923,513, 4,035,185, 4,395,478, and 4,504,570, European Pat. No. 0017148, and *Research Disclosure* RD-No. 16345.

Typical examples of the composition of the present silver halide include silver chloride, silver bromide, and mixed silver halides such as silver chlorobromide, silver chloroiodobromide, and silver iodobromide. The silver halide which can be preferably used in the present invention is silver chloro(iodo)bromide, silver(iodo)chloride, or silver(iodo)bromide containing at most 3 mol% of silver iodide, if any.

The average particle size of the silver halide particles used in the present invention is preferably from 0.1 to 2 μm, particularly from 0.15 to 1 μm. (The average particle size is represented by particle diameter if the particle is spherical or nearly spherical, or by edge length if the particle is cubic. The average value is taken on the basis of projected areas of the particles.) The particle size distribution may be either wide or narrow.

In order to improve graininess or sharpness, a so-called "monodispersed" silver halide emulsion is preferably used in the present invention. Such a monodispersed emulsion has a narrow particle size distribution in which 90% or more, particularly 95% or more of all the particles fall within ±40%, preferably ±30%, more preferably ±20% of the average particle size by number or weight of particles. In order to satisfy gradation required by the light-sensitive material, in emulsion layers having the same color sensitivities, two or more monodispersed silver halide emulsions having different particle sizes or a plurarity of emulsions having the same particle size and different sensitivities may be coated on the same layer in admixture or on separate layers. Two or more polydispersed silver halide emulsions or a combination of a monodispersed emulsion and a polydispersed emulsion may be used separately or in admixture.

The silver halide particles to be used in the present invention may be in the form of a regular crystal shape, such as a cube, octahedron, dodecahedron, and tetradecahedron, or an irregular crystal shape such as a sphere, or a composite thereof. Alternatively, the present silver halide particles may be in the form of tabular (plate-like) particles. Particularly, an emulsion of tabular particles in which particles having an aspect ratio (length/thickness) of 5 or more, particularly 8 or more, accounts for 50% or more of the total projected areas of the particles may be used. The present silver halide emulsion may comprise a mixture of particles having these crystal shapes.

The inside or surface of the silver halide particles in the silver halide emulsion to be used in the present invention can be subjected to chemical sensitization. The chemical sensitization can be accomplished by a sulfur sensitization process, a selenium sensitization process, a reduction sensitization process, a noble metal sensitization process, etc. singly or in combination.

The photographic emulsion to be used in the present invention may be spectrally sensitized with a photographic sensitizing dye in an ordinary manner. Particularly useful dyes which may be used for spectral sensitization are dyes belonging to the groups known as the cyanine dyes, merocyanine dyes, and composite merocyanine dyes. These dyes may be used singly or in combination. These dyes may also be used in combination with supersensitizing dyes. Specific examples of these dyes and their usage are described in *Research Disclosure* RD-No. 17643, pp. 24 to 25 (December, 1978), Chapter IV.

In order to inhibit fogging during preparation, storage or photographic processing of the light-sensitive material or to stabilize the photographic properties of the light-sensitive material, the photographic emulsion to be used in the present invention may include benzenethiosulfonic acids, benzenesulfinic acids, thiocarbonyl compounds, or the like.

Specific examples of such fog inhibitors or stabilizers and their usage are described in U.S. Pat. Nos. 3,954,474 and 3,982,947, Japanese Patent Publication No. 28660/77, *Research Disclosure* RD No. 17643 (December, 1978) Chapters VIA to VIM, and "Stabilization of Photographic Silver Halide Emulsions" (edited by E. J. Birr, published by Focal Press, 1974).

In order to form a direct positive color image, various color couplers can be used. Useful color couplers are compounds which produce or release a substantially nondiffusible dye upon coupling reaction with an oxidation product of a p-phenylenediamine color developing agent and which are substantially nondiffusible themselves. Typical examples of useful color couplers include naphthol or phenol compounds, pyrazolone or pyrazoloazole compounds, and open-chain or heterocyclic ketomethylene compounds. specific examples of these cyan, magenta and yellow couplers which may be used in the present invention are described in patents cited in *Research Disclosure* RD Nos. 17643 (VII-D, December, 1978) and 18717 (November, 1979).

Typical examples of yellow couplers which can be used in the present invention include oxygen atom-releasing type or nitrogen atom-releasing type yellow two-equivalent couplers. Particularly, α-pivaloylacetanilide couplers are excellent in fastness of color forming dye, especially to light. On the other hand, α-benzoylacetanilide couplers are preferably used because they can provide a high color density.

As suitable 5-pyrazolone magenta couplers for the present invention there may be used 5-pyrazolone couplers which are substituted in the 3-position by an arylamino group or acylamino group, particularly sulfur atom-releasing type two-equivalent couplers.

Pyrazoloazole couplers may be more preferably used. As such pyrazoloazole couplers there may be used pyrazolo[5,1-c][1,2,4]triazoles as described in U.S. Pat. No. 3,725,067. Imidazo[1,2-b]pyrazoles as described in U.S. Pat. No. 4,500,630 may be more preferably used in light of the color forming dye having less side yellow absorption and having greater fastness to light. Particularly, pyrazolo[1,5-b][1,2,4]triazoles as described in U.S. Pat. No. 4,540,654 are suitable.

As suitable cyan couplers for the present invention, there may be used phenol cyan couplers containing an ethyl group or higher alkyl group in the meta-position of the phenol nucleus as described in U.S. Pat. No. 3,772,002. Furthermore, 2,5-diacylamino-substituted phenol couplers may be preferably used in the light of its excellent fastness of color image.

Specific examples of such suitable yellow couplers will be shown hereinafter.

(Y-1)
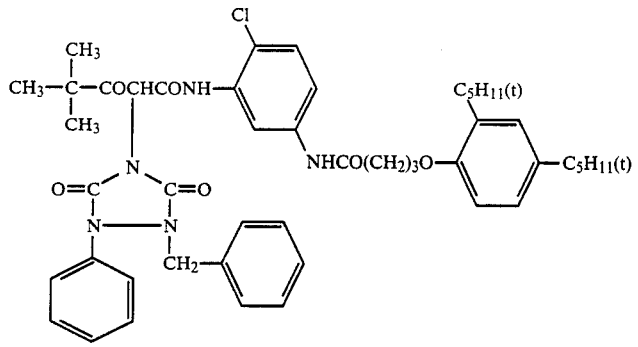
(Y-2)
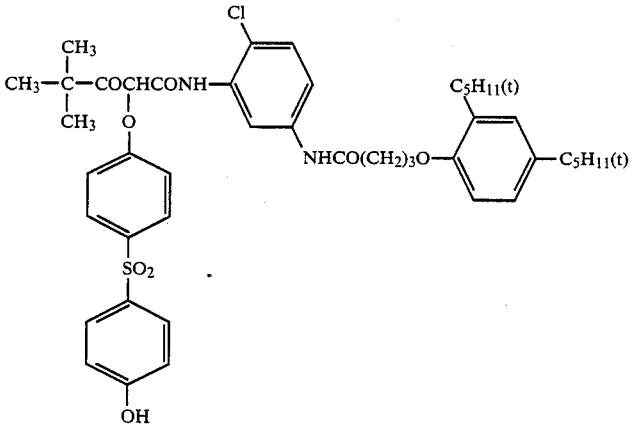
(Y-3)
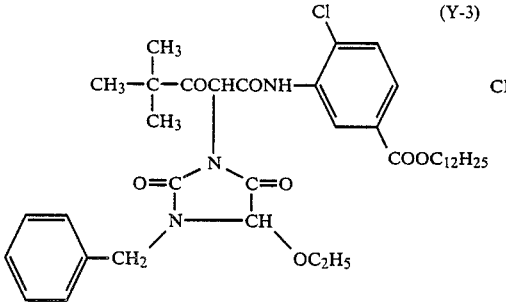
(Y-4)
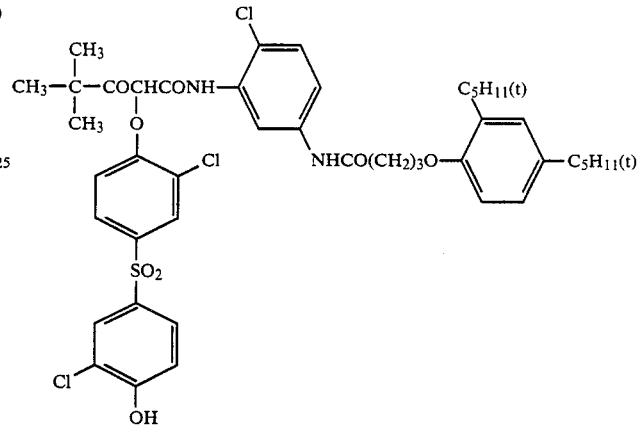
(Y-5)
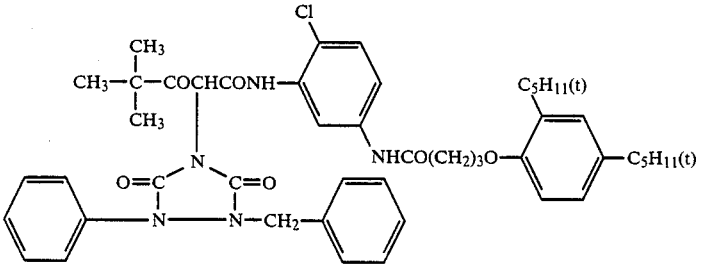

-continued
(Y-6)
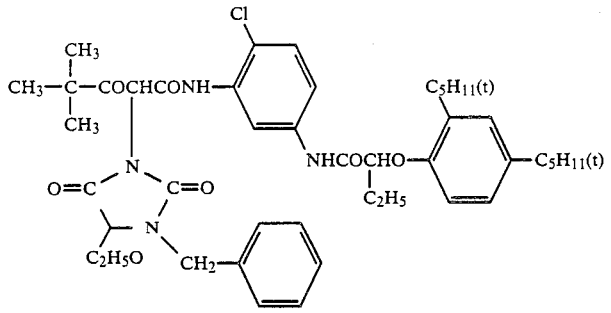
(Y-7)
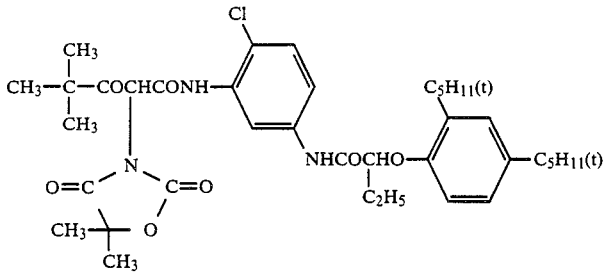
(Y-8)
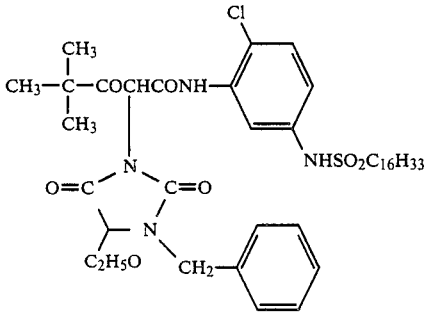
(Y-9)
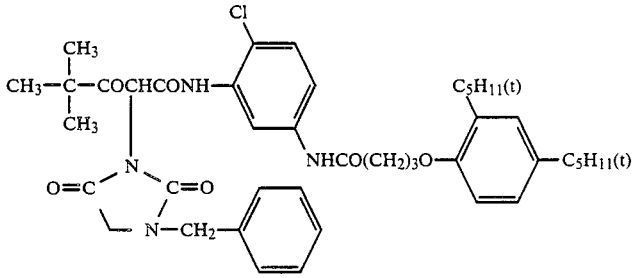
(Y-10)
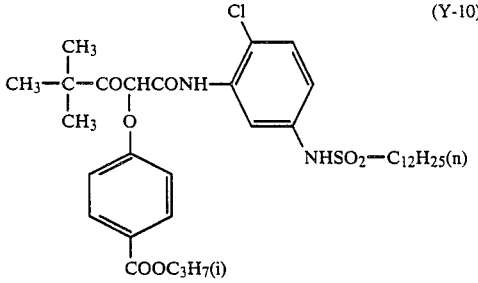
(Y-11)
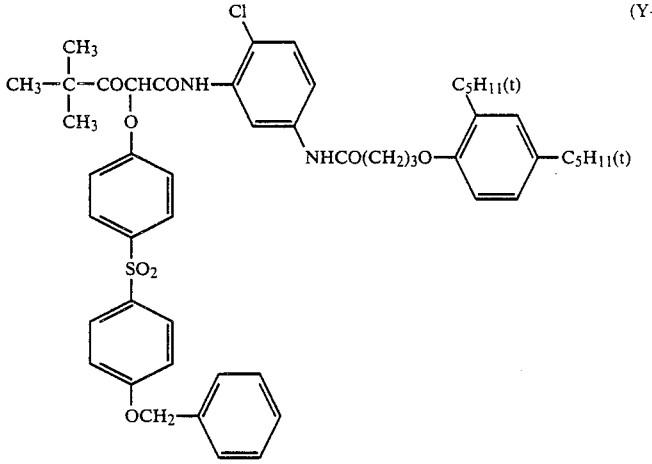
Specific examples of suitable magenta couplers will be shown hereinafter.

(M-1)
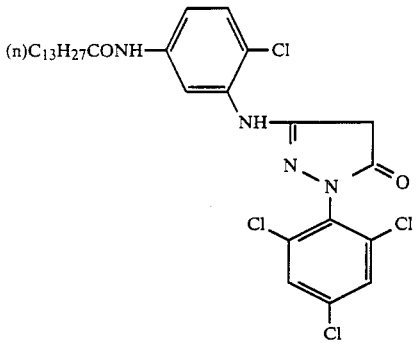
(M-2)
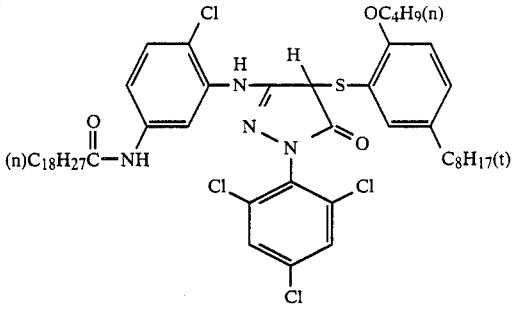
(M-3)
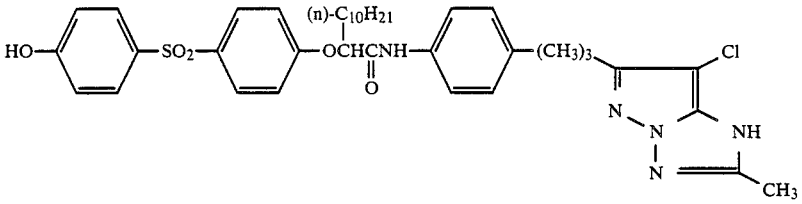
(M-4)
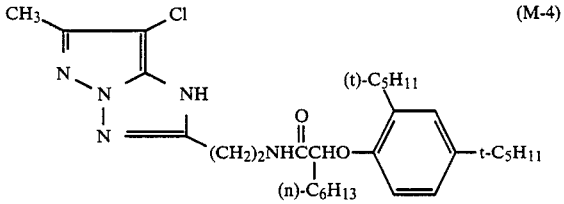
(M-5)
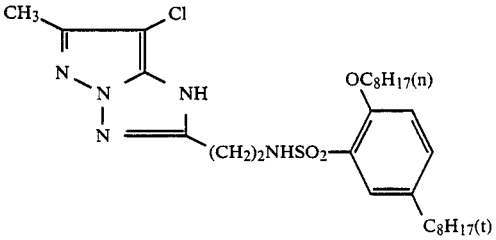
(M-6)
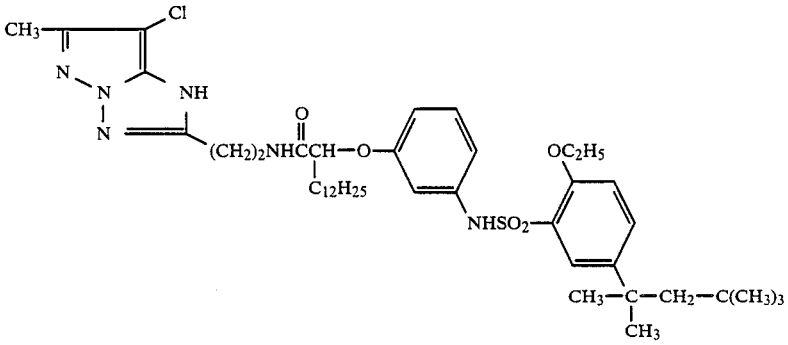
(M-7)
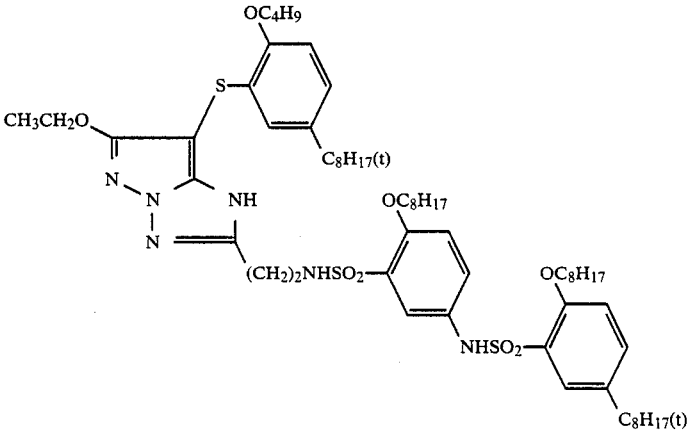

-continued
(M-8)
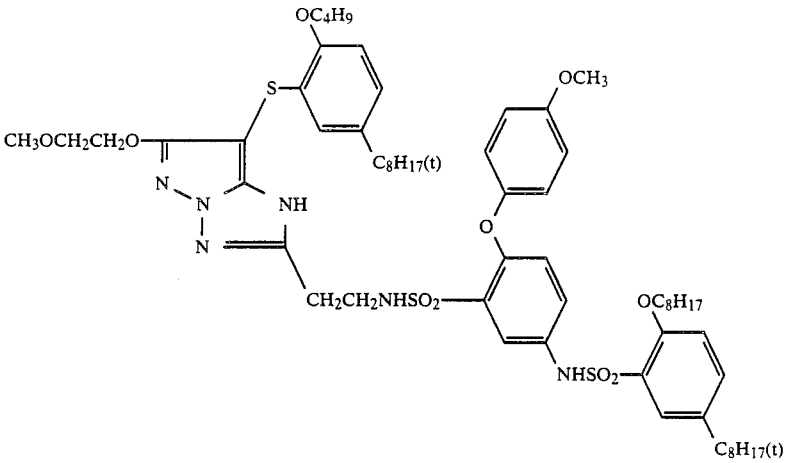
(M-9)
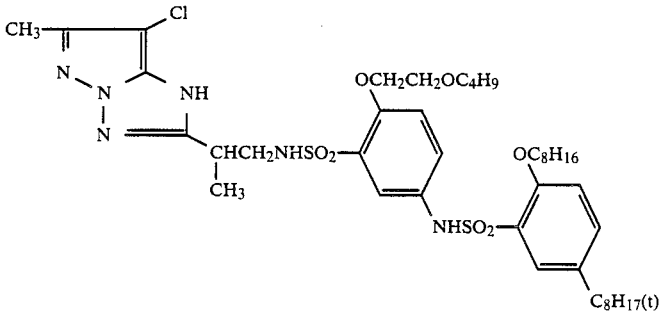
(M-10)
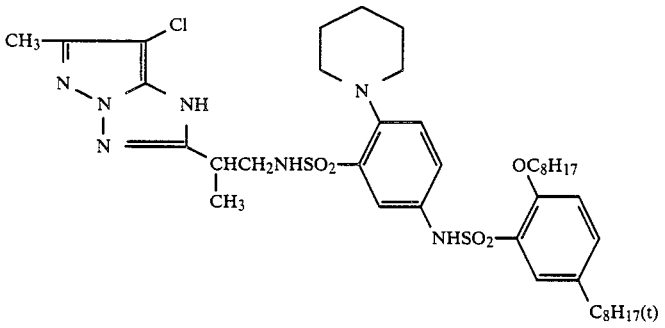
(M-11)
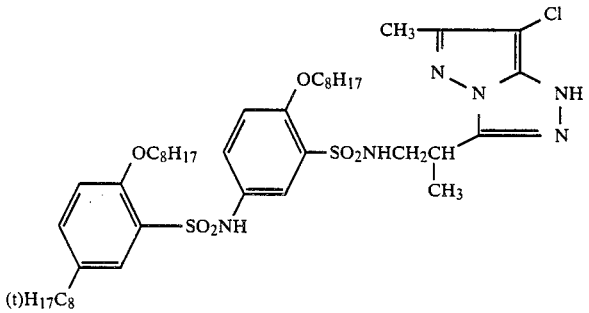

-continued
(M-12)
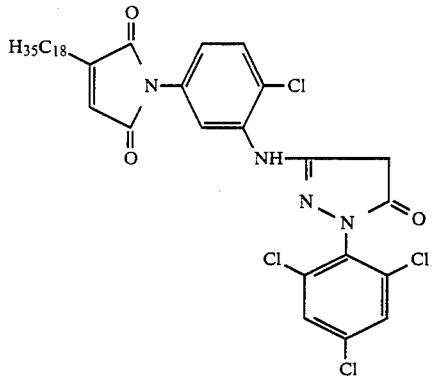
(M-13)
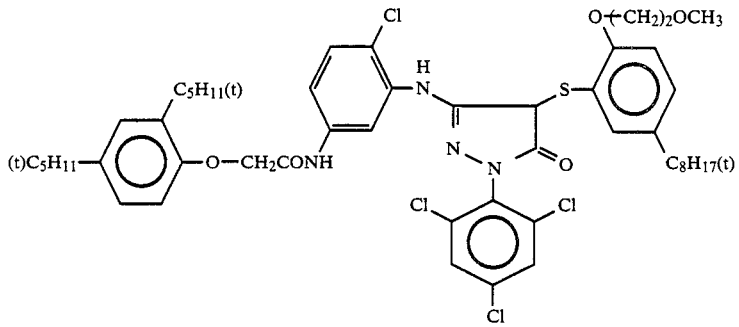
(M-14)
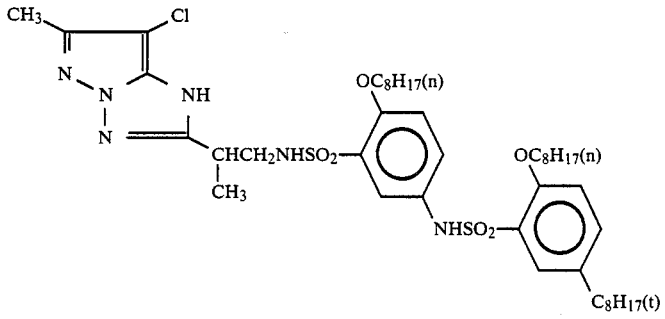
(M-15)
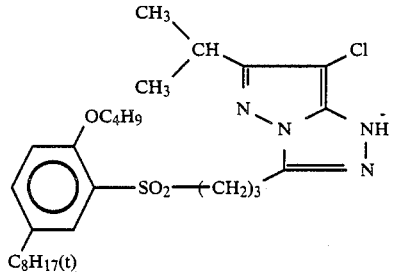
Specific examples of suitable cyan couplers will be shown hereinafter.
(C-1)
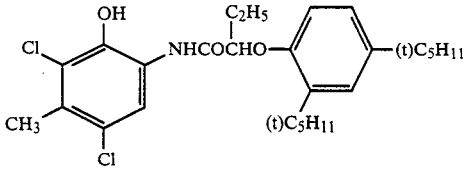
(C-2)
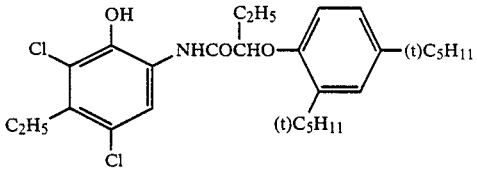

-continued (C-3)

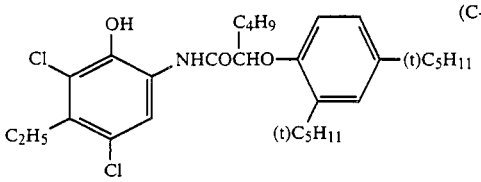

(C-4)

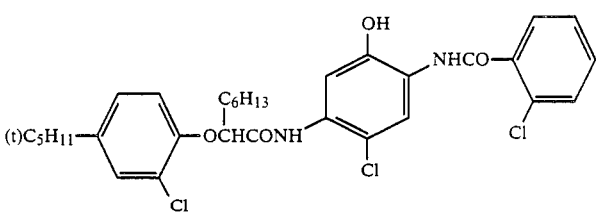

(C-5)

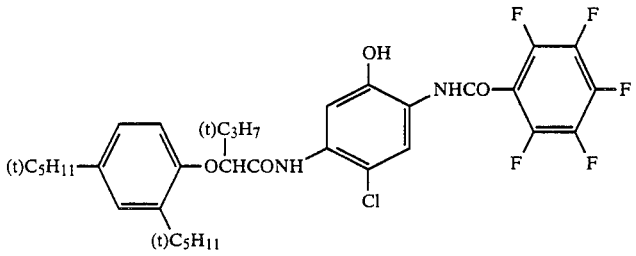

(C-6)

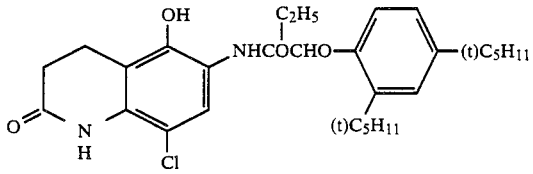

(C-7)

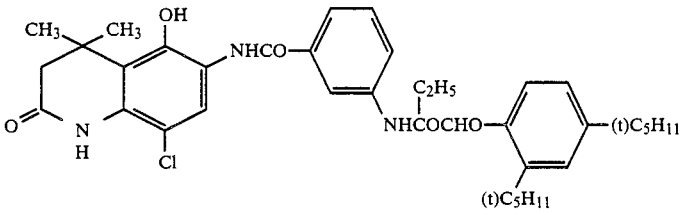

(C-8)

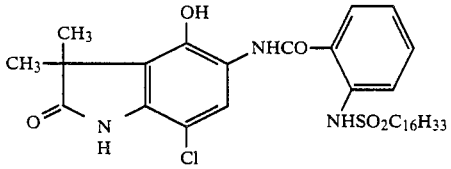

(C-9)

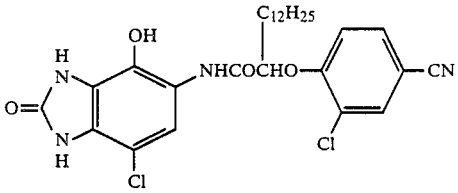

(C-10)

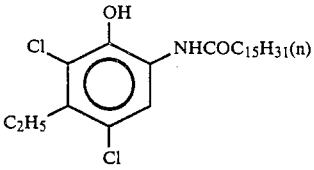

(C-11)

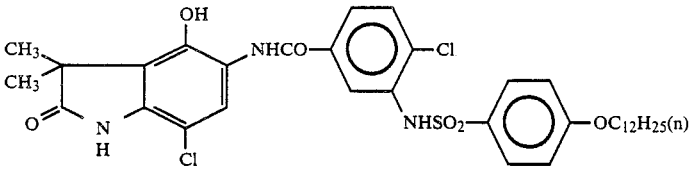

The standard amount of the present color coupler to be used is from 0.001 to 1 mol, preferably from 0.01 to 0.5 mole for yellow coupler, from 0.003 to 0.3 mol for magenta coupler, and from 0.002 to 0.3 mol for cyan coupler per 1 mol of light-sensitive silver halide.

The light-sensitive material prepared in accordance with the present invention may include as a color fog inhibitor or color stain inhibitor a hydroquinone derivative, an aminophenol derivative, amine, a gallic acid derivative, a catechol derivative, an ascorbic acid derivative, a colorless coupler, a sulfonamido phenol derivative, or the like.

The present light-sensitive material may comprise various discoloration inhibitors. Typical examples of suitable organic discoloration inhibitors include hydroquinones, 6-hydroxychromans, 5-hydroxycoumarans, spirochromans, hindered phenols such as p-alkoxyphenols and bisphenols, gallic acid derivatives, methylene dioxybenzenes, aminophenols, hindered amines, and ether or ester derivatives obtained by silylating or alkylating a phenolic hydroxyl group thereof. Furthermore, as suitable organic discoloration inhibitors ther may be used metal complexes such as (bissalicyl aldoximate)nickel complex and (bis-N,N-dialkyldithiocarbamate)nickel complex.

In order to prevent the yellow dye image from being deteriorated by heat, moisture, and light, a compound containing both hindered amine and hindered phenol structures in the same molecule as described in U.S. Pat. No. 4,268,593 may be successfully used.

Furthermore, in order to prevent the magenta dye image from being deteriorated, especially by light, spiroindans as described in Japanese Patent Application (OPI) No. 159644/81 and hydroquinonediether or monoether-substituted chromans as described in Japanese Patent Application (OPI) No. 89835/80 may be successfully used. These compounds may be coemulsified with a coupler in an amount of from 5 to 100% by weight based on the corresponding color couplers and then incorporated in the light-sensitive layer.

In order to prevent the cyan dye image being deteriorated by heat and particularly by light, an ultraviolet absorber may be effectively incorporated in both layers adjacent to the cyan color forming layer. Such an ultraviolet absorber may also be incorporated in a hydrophilic colloidal layer such as a protective layer.

As suitable binders or protective colloids for the emulsion layer or intermediate layer in the the present light-sensitive material, gelatin may be advantageously used. Other hydrophilic colloids can be used.

The present light-sensitive material may comprise a dye for inhibiting irradiation or halation, antistatic agent, lubrication improver, or the like.

Typical examples of such additives are described in *Research Disclosure RD Nos.* 17643 (December, 1978) and 18716 (November, 1979).

The present invention can be applied to a multilayer multicolor photographic material having at least two spectral sensitivities on a support. In general, a multilayer natural color photographic material has at least one red-sensitive emulsion layer, at least one green-sensitive emulsion layer, and at least one blue-sensitive emulsion layer on a support. The order of arrangement of these sensitive layers can be optionally selected. A preferred order of arrangement of these layers in red-sensitive emulsion layer, green-sensitive emulsion layer, and blue-sensitive emulsion layer; or blue-sensitive emulsion layer, red-sensitive emulsion layer, and green-sensitive emulsion layer as reviewed from the support. These emulsion layers may consist of two or more emulsion layers having different sensitivities. Alternatively, a light-insensitive layer may be interposed between two or more emulsion layer having same color sensitivity. In general, the red-sensitive emulsion layer comprises a cyan forming coupler, the green-sensitive emulsion layer comprises a magenta forming coupler, and the blue-sensitive emulsion layer comprises a yellow forming coupler. However, a different combination may be optionally used.

Preferably, the present light-sensitive material properly includes an auxiliary layer such as protective layer, intermediate layer, filter layer, antihalation layer, back layer, and white reflecting layer other than a silver halide emulsion layer.

In the present photographic light-sensitive material, the photographic emulsion layer or other layers may be coated on a flexible support commonly used in photographic light-sensitive material such as plastic film, paper, and cloth, or a rigid support such as glass, ceramics, and metal. As useful flexible supports there may be used paper having a film of semi-synthetic or synthetic high molecular compound such as cellulose nitrate, cellulose acetate, cellulose acetobutyrate, polystyrene, polyvinyl chloride, polyethyleneterephthalate, and polycarbonate, baryta layer, or α-olefin polymer such as polyethylene, polypropylene, and ethylene/butene copolymer coated or laminated thereon. The present support may be colored with a dye or pigment. The support may be blackened for the purpose of light screening. The surface of the support is generally undercoated to facilitate adhesion to the photographic emulsion layer or the like. The surface of the support may be subjected to glow discharge, corona discharge, ultraviolet irradiation, flame treatment, or the like before or after undercoating.

The coating of the silver halide photographic emulsion layer or other hydrophilic colloidal layers can be accomplished by any suitable known method such as the dip coating process, roller coating process, curtain coating process, and extrusion coating process.

The present invention can be applied to various color light-sensitive material. Typical examples of such color light-sensitive materials include color reversal films for slide projection and television presentation, and color reversal papers.

The present invention can also be applied to a full color copier and color hard copier for storing CRT images. The present invention can be further applied to a black-and-white light-sensitive material using a mixture of three color couplers as described in *Research Disclosure* RD No. 17123 (July, 1978).

After being imagewise exposed to light, the present light-sensitive material may be developed with a surface developing solution containing a p-phenylenediamine color developing agent while being fogged by light or nucleating agent, and then subjected to blix to form a direct positive color image thereon.

The present invention is advantageous particularly in that an excellent direct positive color image can be obtained even with a low pH color developing solution having a pH value of 11.3 or below.

The present fogging process can be accomplished by either the so-called "light fogging process" in which the light-sensitive layer is entirely subjected to a second light exposure or the chemical fogging process" in which the light-sensitive layer is developed in the presence of a nucleating agent.

The present entire light exposure of fogging light exposure (as described in British Pat. No. 1,151,363) is effected before and/or during development after being imagewise exposed to light. The light-sensitive material which has been imagewise exposed to light is exposed to light while being dipped in a developing solution or prebath thereof or while being wet after withdrawn from the developing solution or prebath thereof. Most preferably, the light-sensitive material is exposed to light while being dipped in the developing solution.

As the light source for fogging light exposure there may be used a light source having a wavelength in the range of wavelength of light to which the light-sensitive material is sensitive such as fluorescent tube, tungsten lamp, xenon lamp, and sunlight. Specific examples of such fogging light exposure are described in British Pat. No. 1,151,363, and Japanese Patent publication Nos. 12709/70, 12710/70, 22515/71, 6936/83, and 120248/83. For a light-sensitive material having sensitivity to all wavelength ranges such as color light-sensitive material in particular, a light having a high color rendering property (preferably as close to white light as possible) as described in Japanese Patent Application (OPI) Nos. 137350/81, 129438/82, 62652/83, 60739/83, and 70223/83 is preferably used. The illuminating luminosity is from 0.01 to 2,000 lux, preferably from 0.05 to 30 lux, more preferably from 0.05 to 5 lux. The higher the sensitivity of the light-sensitive material, the lower the preferred luminosity. The illuminating luminosity can be adjusted by changing the intensity of the light source, the distance between the light-sensitive material and the light source, or the angle between the light-sensitive material and the light source, or using various filters to lower the intensity of the light source. A light source having a low intensity may be used in the initial stage of light exposure and a light source having a stronger intensity may be used in the latter stage of light exposure so that the exposure time can be shortened.

The irradiation is preferably effected after the emulsion layer of the light-sensitive material is fully wet with a developing solution or prebath thereof in which it is immersed. The time between immersion and light fogging is generally from 2 seconds to 2 minutes, preferably from 5 seconds to 1 minute, more preferably from 10 seconds to 30 seconds.

The time for fogging is generally from 0.01 second to 2 minutes, preferably from 0.1 second to 1 minute, more preferably from 1 second to 40 seconds.

In the present invention, the nucleating agent used in a so-called "chemical fogging process" may be incorporated in the light-sensitive material or processing solution thereof. It may be preferably incorporated in the light-sensitive material.

The term "nucleating agent" as used herein means a substance which acts upon surface development of an unfogged internal latent image type silver halide emulsion to form a direct positive image.

If the nucleating agent is incorporated in the light-sensitive material, it is preferably incorporated in an internal latent image type silver halide emulsion layer. It may be incorporated in other layers such as intermediate layer, undercoat layer, and back layer, so long as it is diffused and adsorbed by silver halide during coating or processing.

If the nucleating agent is incorporated in the processing solution, it may be incorporated in the developing solution or a low pH prebath as described in Japanese Patent Application No. 178350/83.

If the nucleating agent is incorporated in the light-sensitive material, the amount is preferably in the range of from $10^{-8}$ to $10^{-2}$ mol, more preferably from $10^{-6}$ to $10^{-3}$ mol per 1 mol of silver halide.

If the nucleating agent is incorporated in the processing solution, the amount is preferably in the range of from $10^{-5}$ to $10^{-1}$ mol, more preferably from $10^{-4}$ to $10^{-2}$ mol per l. Two or more nucleating agents may be used in combination.

As suitable nucleating agents for the present invention there may be used all compounds which have heretofore been developed for the purpose of nucleating internal latent image type silver halides. Examples of such compounds include those described in *Research Disclosure* RD No. 22534 (pp. 50 to 54, January, 1983). These compounds may be used in combination.

Nucleating agents for the present invention are preferably compounds represented by formulae (N-I) and (N-II)

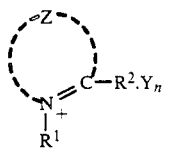

(N-I)

wherein Z represents a nonmetallic atomic group required to form a five- or six-membered heterocyclic ring and may be substituted by substituents; $R^1$ represents an aliphatic group and may be substituted by substituents; $R^2$ represents a hydrogen atom, an aliphatic group, or an aromatic group and may be substituted by a substituents; Y represents a paired ion for electric charge balance; and n and m each represents an integer of 0 or 1, with the proviso that at least one of the group represented by $R^1$, $R^2$ and Z contains an alkynyl group, an acyl group, an hydrazine group, or a hydrazone group or $R^1$ and $R^2$ combine to form a six-membered ring to provide a dihydropyridinium skeleton. At least one of the substituents for $R^1$, $R^2$ and Z may contain $X^1$-$(L^1)_m$ in which $X^1$ represents a group accelerating adsorption to silver halide, and $L^1$ represents a divalent linkage group.

More particularly, examples of the heterocyclic ring formed by Z include quinolinium, benzothiazolium, benzimidazolium, pyridinium, thiazolinium, thiazolium, naphthothiazolium, selenazolium, benzoselenazolium, imidazolium, tetrazolium, indolenium, pyrrolinium, acrydinium, phenanthridinium, isoquinolinium, oxazolium, naphthoxazolium, and benzoxazolium rings.

Examples of the substituents for Z include an alkyl group, an alkenyl group, an aralkyl group, an aryl group, an alkynyl group, a hydroxy group, an alkoxy group, an aryloxy group, a halogen atom, an amino group, an alkylthio group, an arylthio group, an acylamino group, a sulfonyl group, a sulfonyloxy group, a sulfonylamino group, a carboxyl group, an acyl group, a carbamoyl group, a sulfamoyl group, a sulfo group, a cyano group, a ureido group, a urethane group, a carboxylic ester group, a hydrazine group, a hydrazone group, and an imino group. As the substituents for Z there may be at least one selected from the above mentioned groups. If two or more of the groups are used, they may be the same or different. Furthermore, these substituents may be further substituted by these substituents.

Furthermore, as the substituents there may bbe used groups which form a heterocyclic quaternary ammonium salt with Z via a proper linkage group L. In this case, such a substituent is in the form of a dimer.

Preferred examples of the heterocyclic ring formed by Z include quinolinium, benzothiazolium, benzimidazodlium, pyridinium, acrydinium, phenanthridinium, and isoquinolinium rings.

More preferred examples of such heterocyclic rings are quinolinium, benzothiazolium, and benzimidazolium. Most preferred examples of such heterocyclic rings are quinolinium and benzothiazolium.

Examples of the aliphatic groups represented by $R^1$ and $R^2$ are unsubstituted alkyl groups having from 1 to 18 carbon atoms and substituted alkyl groups having an alkyl portion with from 1 to 18 carbon atoms. As the substituents, there may be used those for Z.

The aromatic group represented by $R^2$ is an aromatic group having from 6 to 20 carbon atoms such as phenyl group and naphthyl group. As the substituents for the aromatic group, there may be used those for Z.

The alkynyl group, acyl group, hydrazine group, or hydrazone group, contained in at least one one of the groups $R^1$, $R^2$ and Z or the dihydropyridinium skeleton formed by the combination of $R^1$ and $R^2$ may be substituted by the groups described as the substituents for the group represented by Z.

A preferred example of such a hydrazine group is one containing a substituent such as an acyl group and sulfonyl group.

A preferred example of such a hydrazone group is one containing a substituent such as an aliphatic group and an aromatic group.

Preferred examples of such an acyl group include a formyl group, an aliphatic group, and an aromatic ketone group.

Alkynyl substituent groups contained in any one of $R^1$, $R^2$ and Z have been partially described. More particularly, examples of such alkynyl substituents include an ethynyl group, a propargyl group, a 2-butynyl group, a 1-methylpropargyl group, a 1,1-dimethylpropargyl group, a 3-butynyl group, and a 4-pentynyl group.

These groups may be further substituted by the substituents for Z. Examples of alkynyl substituents thus substituted include a 3-phenylpropargyl group, 3-methoxycarbonylpropargyl group, and 4-methoxy-2-butynyl group.

At least one of the substituents for the group or ring represented by $R^1$, $R^2$ and Z is preferably an alkynyl group or acyl group. Alternatively, $R^1$ and $R^2$ preferably combine to form a dihydropyridinium skeleton. Most preferably, the substituent for the group or ring represented by $R^1$, $R^2$ and Z contains at least one alkynyl group.

Preferred examples of the group accelerating adsorption to silver halide represented by $X^1$ include a thioamide group, a mercapto group, and a five- or six-membered nitrogen-containing heterocyclic group.

The thioamide adsorption acceleration group represented by $X^1$ is a divalent group represented by the formula

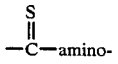

which may be a part of a ring structure or may be a noncyclic thioamide group. Useful thioamide adsorption acceleration groups can be selected from those described in U.S. Pat. Nos. 4,030,925, 4,031,127, 4,080,207, 4,245,037, 4,255,511, 4,266,013, and 4,276,364, and *Research Disclosure* Nos. 15162 (Vol. 151, November, 1976) and 17626 (Vol. 176, December, 1978).

Specific examples of such a noncyclic thioamide group include a thioureido group, thiourethane group, and dithiocarbamic ester. Specific examples of cyclic thioamide groups include a 4-thiazoline-2-thione, 4-imidazoline-2-thione, 2-thiohydantoin, rhodanine, thiobarbituric acid, tetrazoline-5-thione, 1,2,4-thiazoline-3-thione, 1,3,4-thiadiazoline-2-thione, 1,3,4-oxadiazoline-2-thione, benzimidazoline-2-thione, benzoxazoline-2-thione, and benzothiazoline-2-thione. These groups may be further substituted.

The mercapto group represented by $X^1$ is one in which the —SH group is directly bonded to the group represented by $R^1$, $R^2$ or Z or one in which —SH group is bonded to the substituent for the group represented by $R^1$, $R^2$ or Z. Therefore, examples of the mercapto group include an aliphatic mercapto group, an aromatic mercapto group, and a heterocyclic amino group (if the atom next to the carbon atom to which —SH group is bonded is a nitrogen atom, this heterocyclic mercapto group has the same meaning as the cyclic thioamide group in tautomerism therewith. Specific examples of such a group are the same as described above.)

Examples of the five- or six-membered nitrogen-containing heterocyclic group represented by $X^1$ include five- or six-membered nitrogen-containing heterocyclic rings having a combination of at least one of a nitrogen, oxygen, sulfur, and carbon atom. Preferred among these groups are benzotriazole, triazole, tetrazole, indazole, benzimidazole, imidazole, benzothiazole, thiazole, benzoxazole, oxazole, thiadiazole, oxadiazole, and triazine. These groups may be further substituted by proper substituents. As such substituents there may be used those for Z. More preferably, the nitrogen-containing heterocyclic group is benzotriazole, triazole, tetrazole, or indazole. Most preferably, the nitrogen-containing heterocyclic ring is benzotriazole.

The divalent linkage group represented by $L^1$ is an atom or atomic group containing at least one selected from C, N, S, and O. More particularly, as such a linkage group there may be used an alkylene group, an alkenylene group, a phenylalkylene group, an arylene group, —O—, —S—, —NH—, —N=, —CO—, or —$SO_2$—, singly or in combination. These groups may contain a substituent.

The paired ion Y for electric charge balance is any suitable anion capable of cancelling the positive electric charge developed by the quaternary ammonium salt in the heterocyclic ring. Examples of such an anion include a bromine ion, chlorine ion, iodine ion, p-toluenesulfonic acid ion, ethylsulfonic acid ion, perchloric acid ion, trifluoromethanesulfonic acid ion, and thiocyan ion. In this case, n is 1. If the heterocyclic quaternary ammonium salt contains an anion substituent such as sulfoalkyl substituent, it may be in the form of betaine. In this case, no paired ion is necessary, and n is 0. If the heterocyclic quaternary ammonium salt contains two anion substituents, e.g., two sulfoalkyl groups, Y is a cationic paired ion. Examples of such a cationic paired ion include an alkali metal ion such as a sodium ion and potassium ion, and ammonium salt such as triethylammonium.

Specific examples of the compound represented by formula (N-I) will be shown hereinafter, but the present invention should not be construed as being limited thereto.

(N-1)

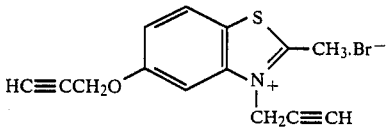

(N-2)

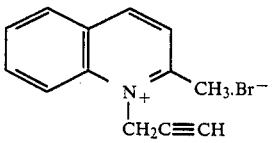

-continued
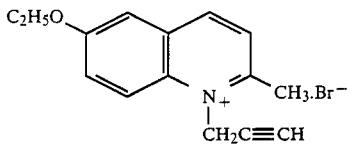
(N-3)
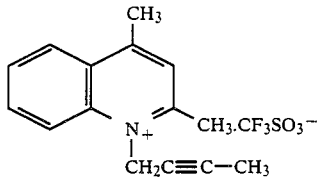
(N-4)
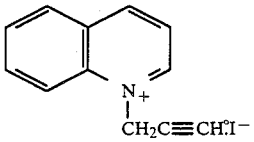
(N-5)
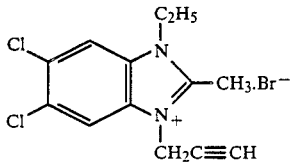
(N-6)
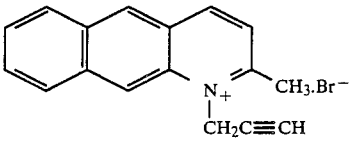
(N-7)
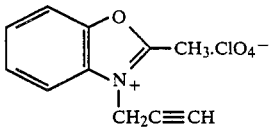
(N-8)
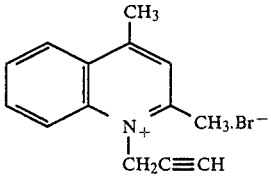
(N-9)
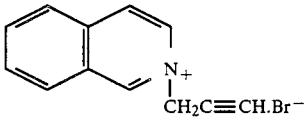
(N-10)
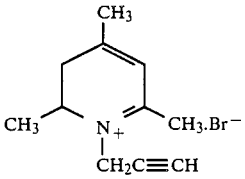
(N-11)
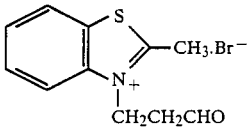
(N-12)
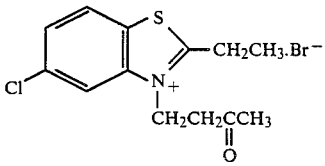
(N-13)
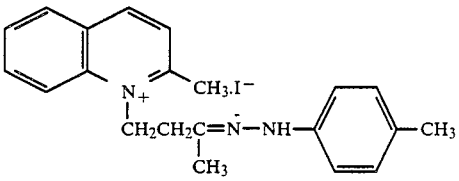
(N-14)
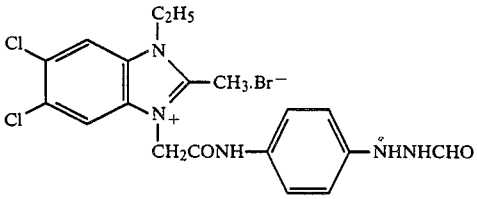
(N-15)
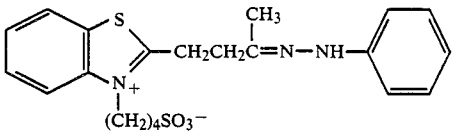
(N-16)
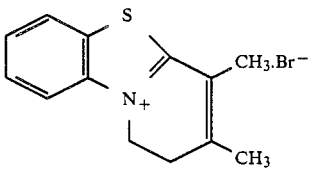
(N-17)
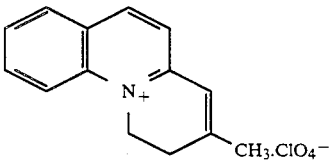
(N-18)

-continued
(N-19)
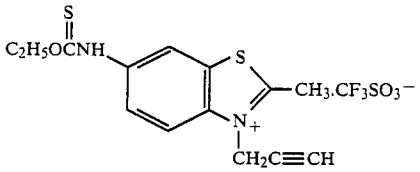
(N-20)
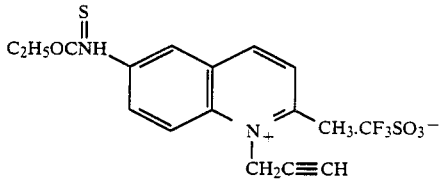
(N-21)
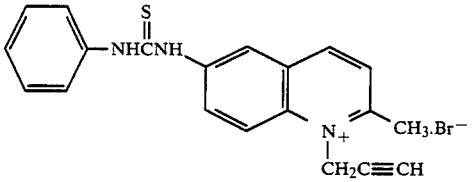
(N-22)
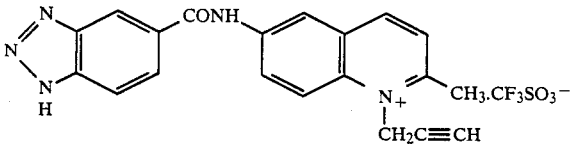
(N-23)
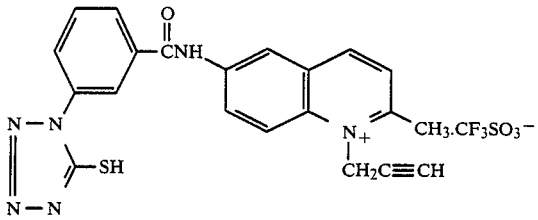
(N-24)
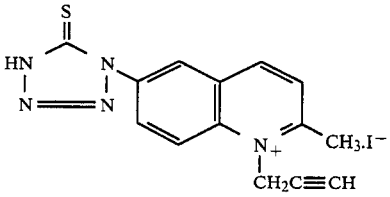
(N-25)
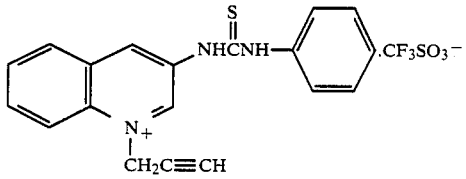
(N-26)
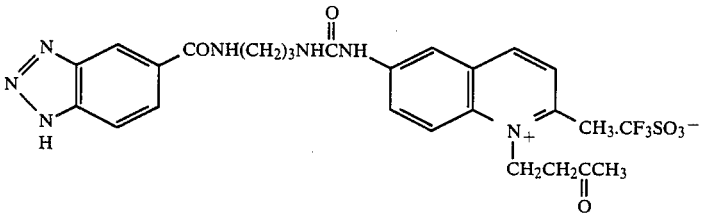
(N-27)
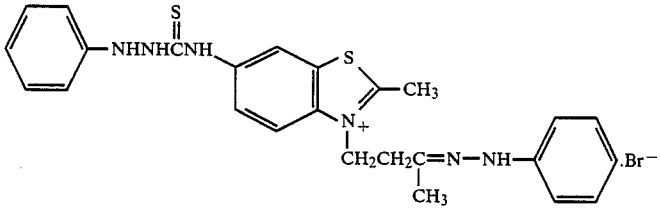
(N-28)
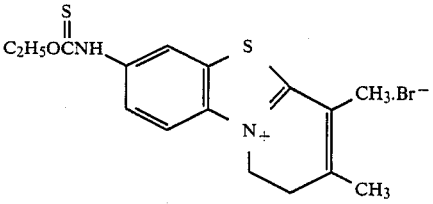

-continued (N-29)

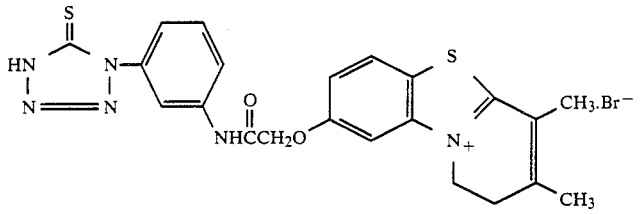

(N-30)

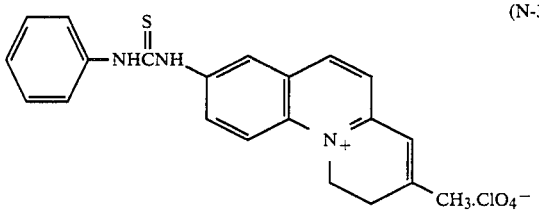

(N-31)

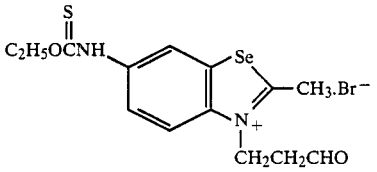

(N-32)

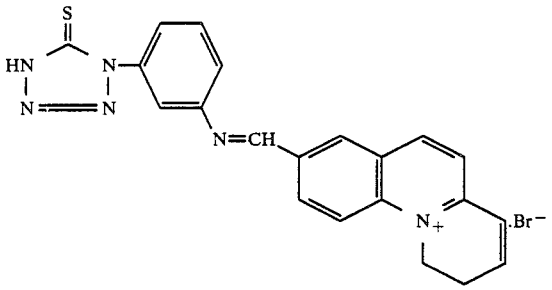

(N-33)

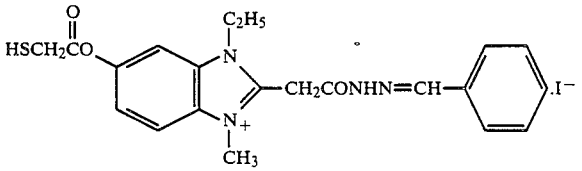

(N-34)

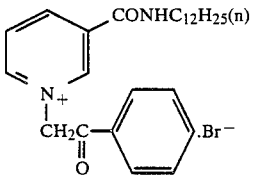

(N-35)

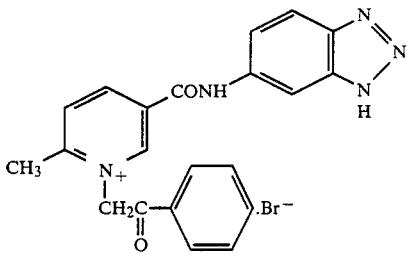

The synthesis of the above mentioned compounds can be accomplished by any suitable methods as described in patents cited in *Research Disclosure* RD No. 22534 (pp. 50 to 54, January, 1983) and U.S. Pat. No. 4,471,044 or analogous methods.

$$R^{21}-\underset{\underset{R^{23}}{|}}{N}-\underset{\underset{R^{24}}{|}}{N}-G-R^{22} \qquad \text{(N-II)}$$

wherein $R^{21}$ represents an aliphatic group, an aromatic group, or a heterocyclic group; $R^{22}$ represents a hydrogen atom, an alkyl group, an aralkyl group, an aryl group, an alkoxy group, an aryloxy group, or an amino group; G represents a carbonyl group, a sulfonyl group, a sulfoxy group, a phospholyl group, or an iminomethylene group (NH=C<); and $R^{23}$ and $R^{24}$ each represents a hydrogen atom or one of $R^{23}$ and $R^{24}$ represents a hydrogen atom and the other represents an alkylsulfonyl group, an arylsulfonyl group, or an acyl group, with the proviso that G, $R^{23}$, $R^{24}$ and a nitrogen atom in hydrazine may combine to form a hydrazone structure (>N—N=C<). The above mentioned groups may be optionally substituted by substituents.

In formula (N-II) the aliphatic group represented by $R^{21}$ is a straight-chain, branched-chain or cyclic alkyl, alkenyl or alkynyl group.

The heterocyclic group represented by $R^{21}$ is a three- to ten-membered saturated or unsaturated heterocyclic ring containing at least one of N, O, and S. The heterocyclic group may be monocyclic or may form a condensed ring with other aromatic rings or heterocyclic rings. The heterocyclic group represented by $R^{21}$ is preferably a five- or six-membered aromatic heterocyclic group such as a pyridyl group, quinolinyl group, imidazolyl group, and benzimidazolyl group.

The heterocyclic group represented by $R^{21}$ may be substituted by substituents. As suitable substituents there may be used those as described hereinafter. The substituents may be further substituted.

The aromatic group represented by $R^{21}$ is preferably a monocyclic or bicyclic aryl group such as phenyl group and naphthyl group.

If G is a carbonyl group, preferred examples of the group represented by $R^{22}$ include a hydrogen atom, an alkyl group such as a methyl group, a trifluoromethyl group, a 3-hydroxypropyl group, and a 3-methanesulfonamidepropyl group, an aralkyl group such as an o-hydroxybenzyl group, and an aryl group such as a phenyl group, a 3,5-dichlorophenyl group, an o-methanesulfonamidophenyl group, and a 4-methanesulfonylphenyl group. Most preferred among these groups is a hydrogen atom. If G is a sulfonyl group, $R^{22}$ is preferably an alkyl group such as a methyl group, an aralkyl group such as an o-hydroxyphenylmethyl group, and aryl group such as a phenyl group, or a substituted amino group such as a dimethylamino group.

As the substituents for $R^{22}$, those for $R^{21}$ may be used. Besides these substituents, an amyl group, an amyloxy group, an alkyl- or acyloxycarbonyl group, an alkenyl group, an alkynyl group, and a nitro group can be used.

These substituents may be further substituted by these substituents. If possible, these substituents may combine to form a ring.

$R^{21}$ or $R^{22}$, particularly $R^{21}$, preferably contain non-diffusible groups such as couplers, i.e., so-called ballast groups. Such a ballast group is a group containing 8 or more carbon atoms and having a combination of at least one of an alkyl group, a phenyl group, an ether group, an amide group, a ureido group, a urethane group, a sulfonamide group, and a thioether group.

$R^{21}$ or $R^{22}$ may contain a group $X^2\text{-}(L^2)_{m2}$ for accelerating the adsorption of a compound represented by formula (N-II) to the surface of the silver halide particles. Herein, $X^2$ has the same meaning as $X^1$ in formula (N-I). $X^2$ is preferably a thioamide group (except thiosemicarbazide and substituted compounds thereof), a mercapto group, or a five- or six-membered nitrogen-containing heterocyclic group. $L^2$ represents a divalent linkage group and has the same meaning as $L^1$ in formula (N-I). In the above formula, $m^2$ represents an integer of 0 or 1.

$X^2$ is more preferably a cyclic thioamide group, i.e., a mercapto-substituted nitrogen-containing heterocyclic group such as a 2-mercaptothiadiazole group, a 3-mercapto-1,2,4-triazole group, a 5-mercaptotetrazole group, a 2-mercapto-1,3,4-oxadiazole group, and a 2-mercaptobenzoxazole group, or a nitrogen-containing heterocyclic group such as a benszotriazole group, a benzimidazole group, and an indazole group.

$R^{23}$ and $R^{24}$ each is preferably a hydrogen atom, an alkylsulfonyl group or an arylsulfonyl group containing 20 or less carbon atoms, which is substituted so that the sum of Hammett's substituent constants is −0.5 or more, or an acyl group containing 20 or less carbon atoms, which is preferably a benzoyl group or a benzoyl group substituted so that the sum of Hammett's substituent constants is −0.5 or more, or a straight-chain, branched-chain, or cyclic unsubstituted or substituted aliphatic acyl group (as substituents there may be used halogen atom, an ether group, a sulfonamide group, a carbonamide group, hydroxyl group, and sulfonic acid group).

$R^{23}$ and $R^{24}$ each is most preferably a hydrogen atom.

G in formula (N-II) is most preferably a carbonyl group.

Specific examples of the compound represented by formuloa (N-II) will be shown hereinafter, but the present invention should not be construed as being limited thereto.

(N-36)

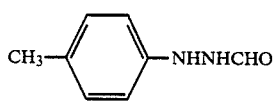

(N-37)

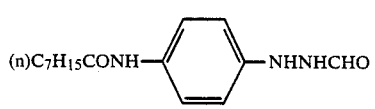

(N-38)

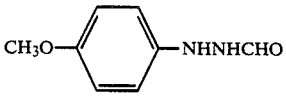

(N-39)

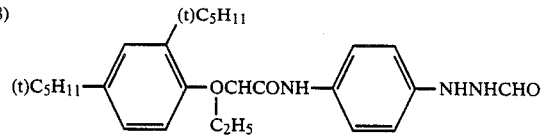

(N-40)

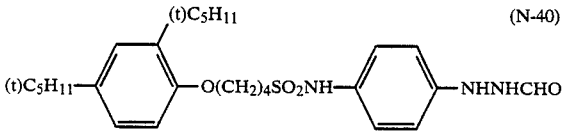

(N-41)

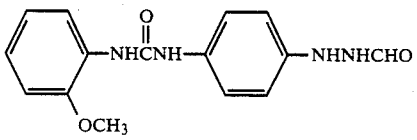

(N-42)

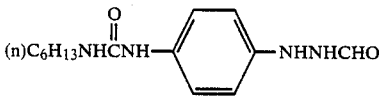

(N-43)

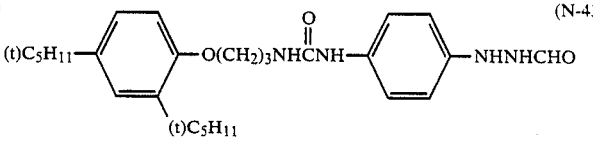

-continued
(N-44)
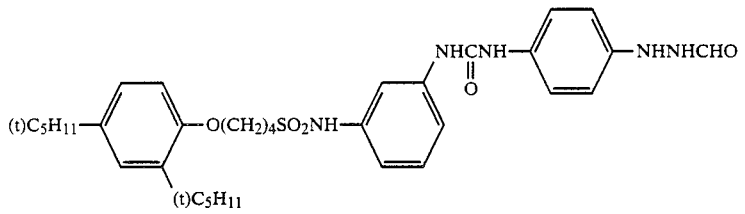
(N-45)
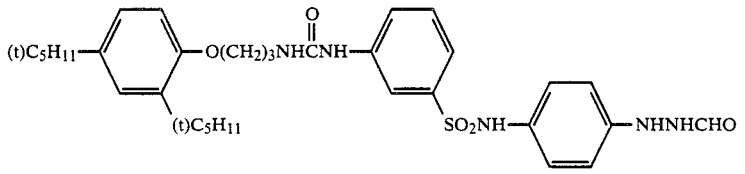
(N-46)
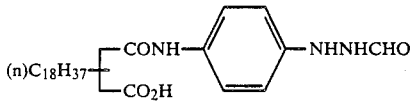
(N-47)
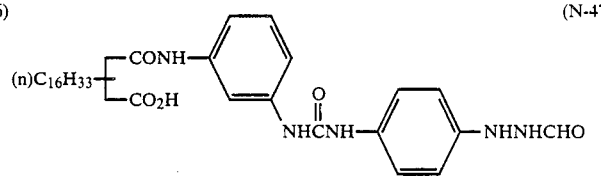
(N-48)
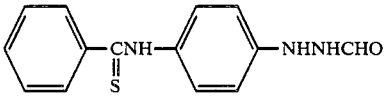
(N-49)
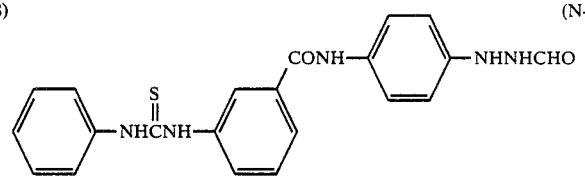
(N-50)
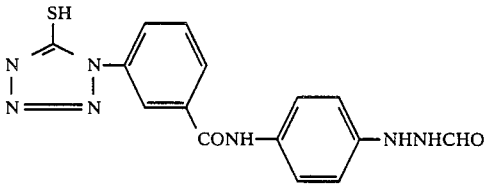
(N-51)
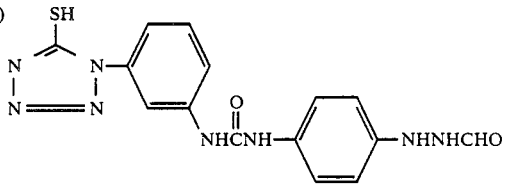
(N-52)
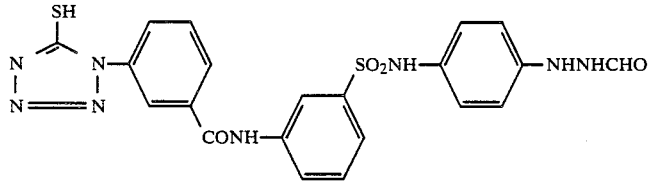
(N-53)
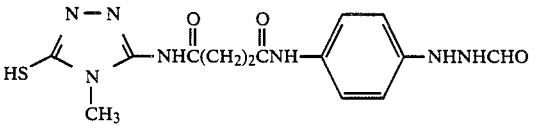
(N-54)
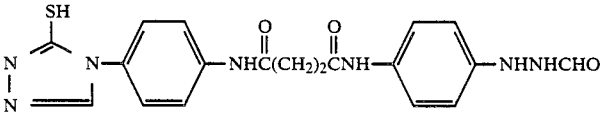
(N-55)
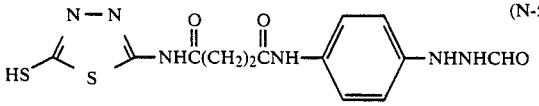
(N-56)
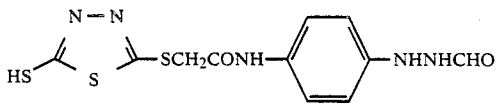

-continued
(N-57)
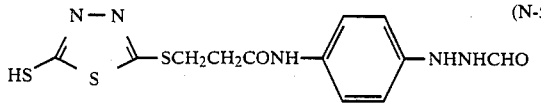
(N-58)
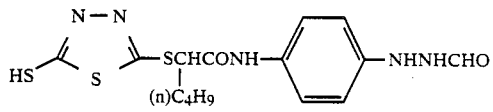
(N-59)
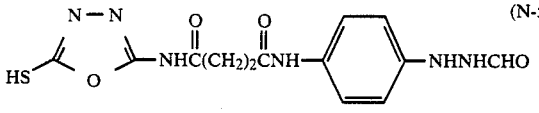
(N-60)
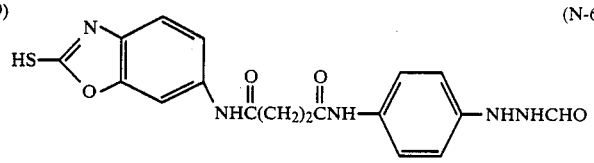
(N-61)
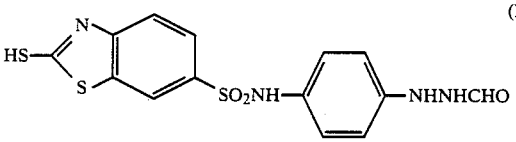
(N-62)
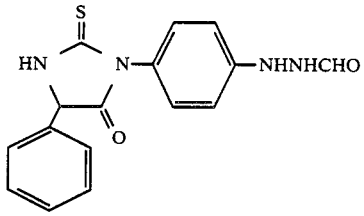
(N-63)
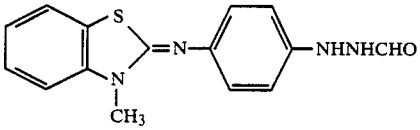
(N-64)
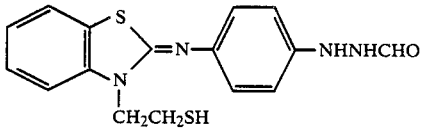
(N-65)
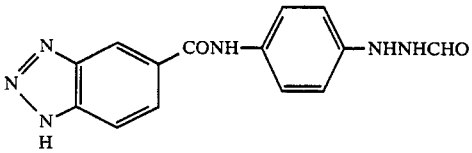
(N-66)
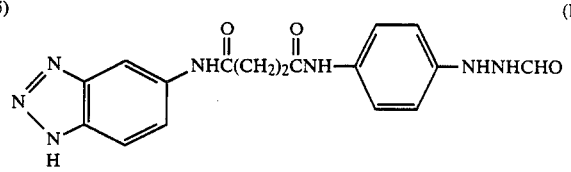
(N-67)
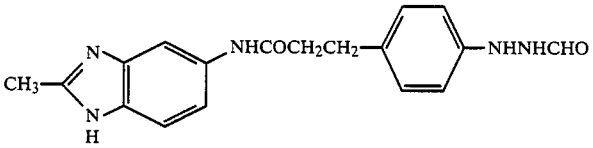
(N-68)
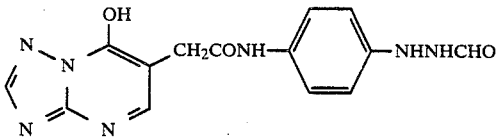
(N-69)
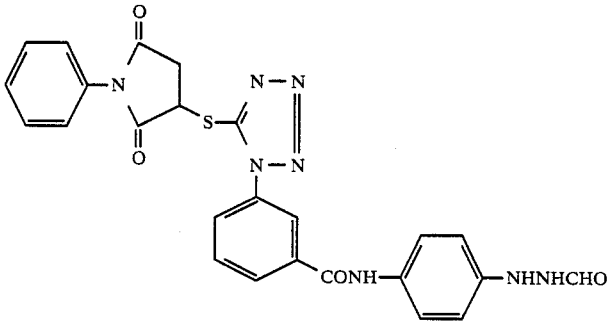

-continued (N-70)

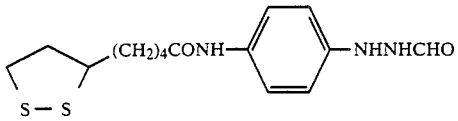

(N-71)

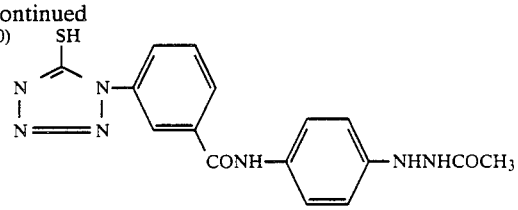

(N-72)

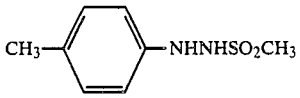

(N-73)

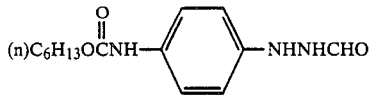

(N-74)

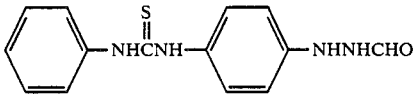

(N-75)

$(n)C_{12}H_{25}NHNHCHO$ (N-76)

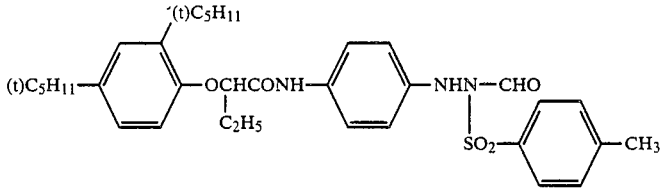

(N-77)

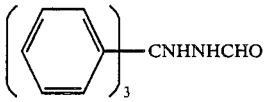

(N-78)

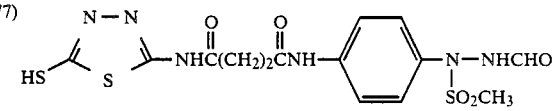

(N-79)

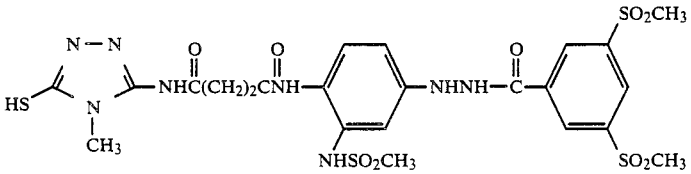

The synthesis of the compound of formula (N-II) to be used in the present invention can be accomplished by any suitable method as described in patents cited in *Research Disclosure* RD Nos. 15162 (pp. 76 to 77, November, 1976), 22534 (pp. 50 to 54, January, 1983), and 23510 (pp. 346 to 352, November, 1983), U.S. Pat. Nos. 4,080,207, 4,269,924, 4,276,364, 4,278,748, 4,385,108, 4,459,347, 4,478,928, and 4,560,638, British Pat. No. 2,011,391B and Japanese Patent Application (OPI) No. 179734/85.

In order to raise the maximum image density, lower the minimum image density, improve stability of light-sensitive material, or speed development, the present light-sensitive material can contain the following compounds:

Hydroquinones such as compounds as described in U.S. Pat. Nos. 3,227,552, and 4,279,987, chromans such as compounds as described in U.S. Pat. No. 4,268,621, Japanese Patent Application (OPI) No. 103031/79, and *Research Disclosure* RD No. 18264 (June, 1979) pp. 333 to 334), quinones such as compounds as described in *Research Disclosure* RD No. 21206 (pp. 433 to 434, December, 1981), amines such as compounds as described in U.S. Pat. No. 4,150,993 and Japanese Patent Application (OPI) No. 174757/83, oxidizing agents such as compounds as described in Japanese Patent Application (OPI) No. 260039/85, and *Research Disclosure* RD No. 16936 (pp. 10 to 11, May, 1978), catechols such as compounds as described in Japanese Patent Application (OPI) Nos. 21013/80 and 65944/80, compounds which release a nucleating agent upon development such as compounds as described in Japanese Patent Application (OPI) No. 107029/85, thiourease such as compounds as described in Japanese Patent Application (OPI) No. 95533/85, and spirobisindanes such as compounds as described in Japanese Patent Application (OPI) No. 65944/80.

As a nucleating accelerator which may be incorporated in the light-sensitive material, nucleating agent bath, or developing bath, there may be used tetrazaindenes, triazaindenes, or pentazaindenes containing at least one mercapto group which may be optionally substituted by an alkali metal atom or ammonium group, or a compound of formula (A-I) or (A-II)

(A-I)

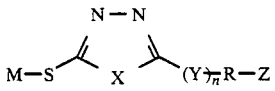

wherein M represents a hydrogen atom, an alkali metal atom, an ammonium group, or a group which undergoes cleavage under an alkaline condition; X represents an oxygen atom, a sulfur atom, or a selenium atom; Y represents —S—,

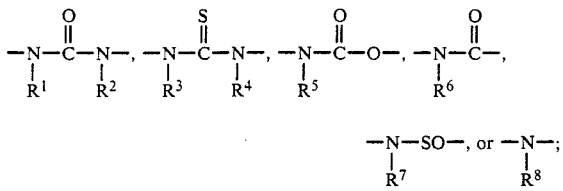

$R_1$, $R_2$, $R_3$, $R_4$, $R_5$, $R_6$, $R_7$ and $R_8$ each represents a hydrogen atom, a substituted or unsubstituted alkyl, aryl, alkenyl, or aralkyl group; R represents a straight-chain or branched-chain alkylene group, a straight-chain or branched-chain alkenylene group, or a straight-chain or branched-chain aralkylene or arylene group; Z represents a hydrogen atom, a halogen atom, a nitro group, a cyano group, or a substituted or unsubstituted amino group, a quaternary ammonium group, an alkoxy group, an aryloxy group, an alkylthio group, an arylthio group, a heterocyclic oxy group, a heterocyclic thio group, a sulfonyl group, a carbamoyl group, a sulfamoyl group, a cabonamide group, a sulfonamide group, an acyloxy group, a sulfonyloxy group, a ureido group, a thioureido group, an acyl group, a heterocyclic group, an oxycarbonyl group, an oxysulfonyl group, an oxycarbonylamino group or a mercapto group; and n represents an integer of 0 or 1.

(A-II)

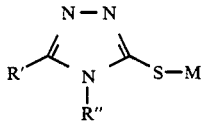

wherein R′ represents a hydrogen atom, a halogen atom, a nitro group, a mercapto group, an unsubstituted amino group or $-Y')_nR-Z$ group; R″ represents a hydrogen atom, an unsubstituted amino group or $-Y')_mR-Z$ group; Y′ represents

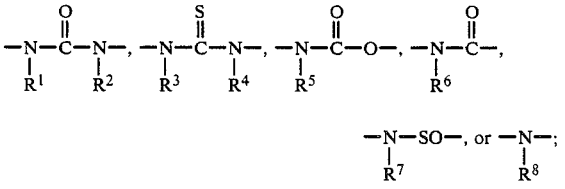

m represents an integer of 0 or 1; and M, R, Z, Y, n, $R_1$, $R_2$, $R_3$, $R_4$, $R_5$, $R_6$, $R_7$, and $R_8$ are as defined in the general formula (A-I).

In the formulae (A-I) and (A-II), Z preferably represents a substituted or unsubstituted amino group, a quaternary ammonium group, an alkoxy group, an alkylthio group, or a heterocyclic group.

Typical examples of suitable nucleation accelerators will be shown hereinafter.

(A-1)

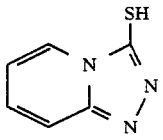

-continued (A-2)

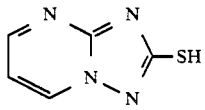

(A-3)

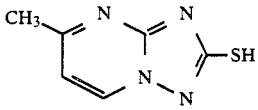

(A-4)

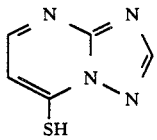

(A-5)

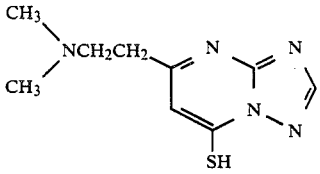

(A-6)

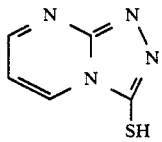

(A-7)

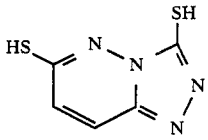

(A-8)

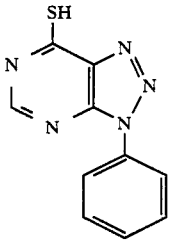

(A-9)

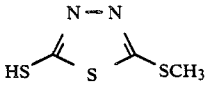

(A-10)

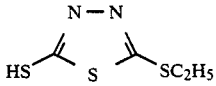

(A-11)

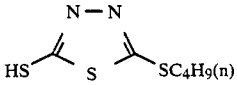

(A-12)

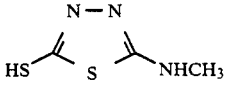

(A-13)

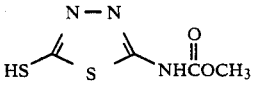

-continued
(A-14)
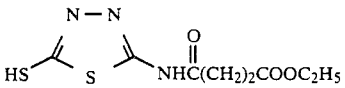
(A-15)
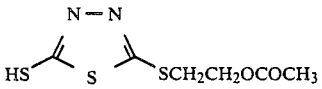
(A-16)
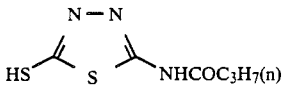
(A-17)
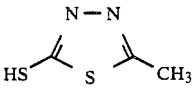
(A-18)
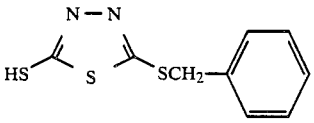
(A-19)
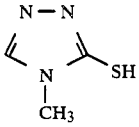
(A-20)
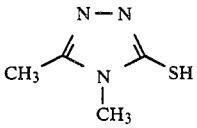
(A-21)
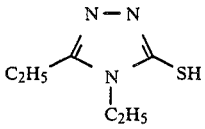
(A-22)
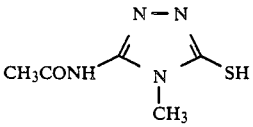
(A-23)
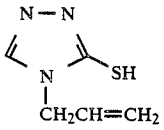
(A-24)
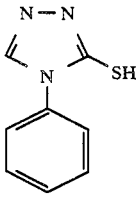
-continued
(A-25)
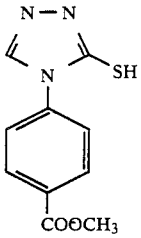
(A-26)
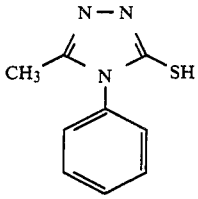
(A-27)
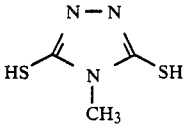
(A-28)
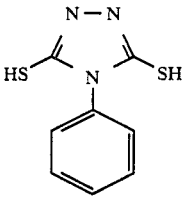
(A-29)
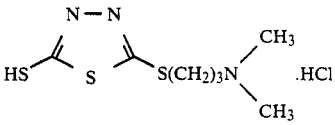
(A-30)
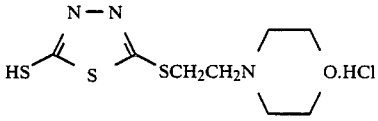
(A-31)
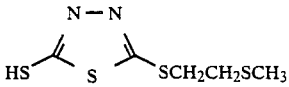
(A-32)
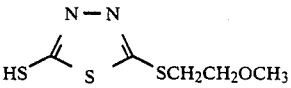
(A-33)
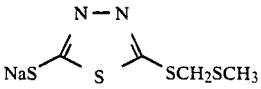
(A-34)
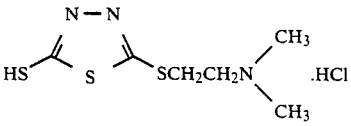

-continued
(A-35)
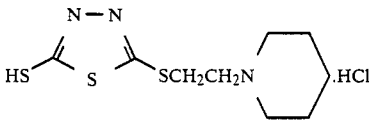
(A-36)
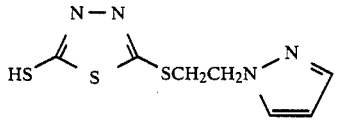
(A-37)
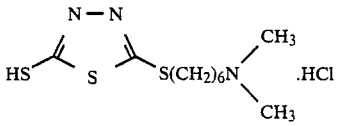
(A-38)
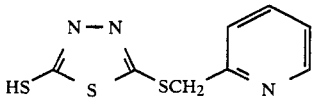
(A-39)
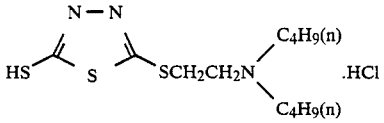
(A-40)
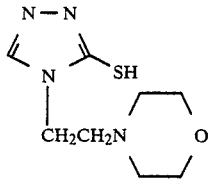
(A-41)
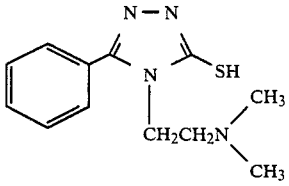
(A-42)
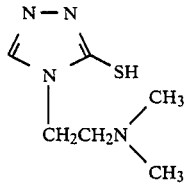
(A-43)
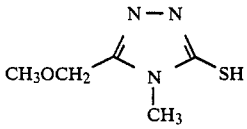
(A-44)
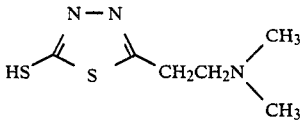
(A-45)
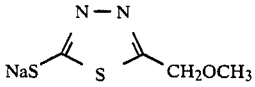
-continued
(A-46)
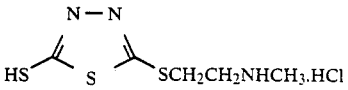
(A-47)
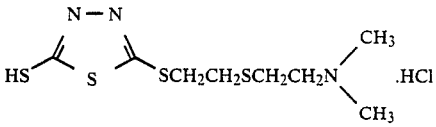
(A-48)
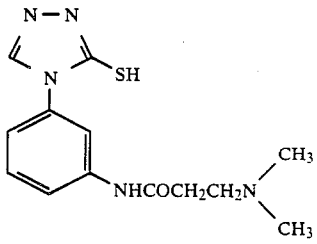
(A-49)
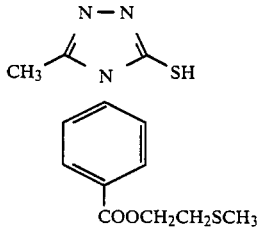
(A-50)
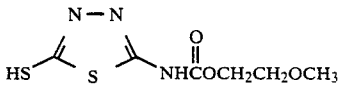
(A-51)
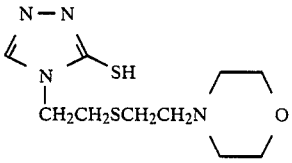
(A-52)
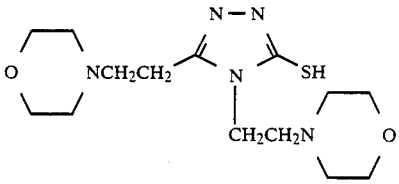
(A-53)
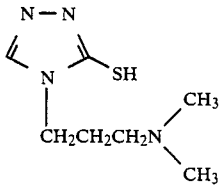
(A-54)
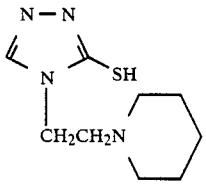

-continued

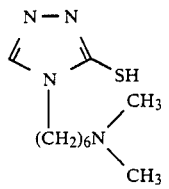

(A-55)

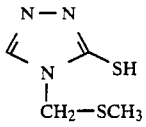

(A-56)

The color developing solution to be used in the development of the present light-sensitive material is a so-called surface developing solution substantially free of a silver solvent and in an alkaline aqueous solution mainly comprising a p-phenylene diamine color developing agent. The term "substantially free of a silver halide solvent" as used herein means that the solution may contain small amount of a silver halide solvent so long as it does not hamper the objects of the present invention.

The pH value of the color developing solution to be used in the present invention is not specifically limited. The reduction of the minimum image density, which is one of the objects of the present invention, can be accomplished within the pH range commonly used in the art. A color developing solution stable to air oxidation having a low pH value as 11.3 or below is advantageous in that the above object can be readily accomplished. Accordingly, the pH value of the present color developing solution is preferably from 9.5 to 11.3, particularly from 10.0 to 11.0. Typical examples of such a p-phenylene diamine compound include 3-methyl-4-amino-N,N-diethylaniline, 3-methyl-4-amino-N-ethyl-N-β-hydroxyethylaniline, 3-methyl-4-amino-N-ethyl-N-β-methylsulfonamidoethylaniline, 3-methyl-4-amino-N-ethyl-N-β-methoxyethylaniline, and sulfates, hydrochlorides, phosphates, p-toluenesulfonates, tetraphenylborates, and p-(t-octyl)benzenesulfonates thereof. These diamines are generally stable in the salt form rather than in the free state.

The present color developing agent is generally used in the concentration of from about 0.1 g to about 30 g, preferably about 1 g to about 15 g per 1 l of color developing solution. The amount of the present color developing solution to be refilled can be reduced by using a refilling solution whose concentration of silver halide, color developing agent, or the like has been properly adjusted.

The present color development time is normally 5 minutes or less. In order to speed processing, color development time is preferably 2 minutes and 30 seconds or less, more preferably from 10 seconds to 2 minutes. If a sufficient color density can be obtained, a shorter color development time is preferably used.

In order to prevent pollution, facilitate preparation of the solution, and improve stability, the present color developing solution preferably is substantially free of a benzyl alcohol. The term "substantially free of a benzyl alcohol" as used herein means that the color developing solution may contain 2 ml/l or less, preferably 0.5 ml/l or less, most preferably no benzyl alcohol.

In order to simplify the speed processing, the present silver halide color light-sensitive material may comprise a color developing agent or precursor thereof. To this end, a precursor of a color developing agent is preferably used because it provides better stability for the light-sensitive material. Specific examples of such a color developing agent precursor include indoaniline compounds, Schiff basee type compounds, aldol compounds, and urethane compounds.

In orderrto accelerate color development, the present silver halide color photographic material may contain various 1-phenyl-3-pyrazolidones.

The present color developing solution may contain a pH buffer and a metallic chelate preservative compound as described in Japanese Patent Application No. 23462/86. The present color developing solution may also contain a silver halide ion such as a bromide ion and an iodide ion, and a competing coupler such as citrazinic acid.

The photographic emulsion layer which has been color-developed is generally subjected to bleaching. Bleaching may be carried out in a combined bleach and fixing (blix) at the same time with fixing or separate from the fixing step. In order to further speed processing, the photographic emulsion layer which has been bleached may be subjected to blix or the photographic emulsion layer which has been fixed may be subjected to blix.

As a bleaching agent for bleach or blix there may preferably be used an organic complex salt or persulfate or iron (III) to attain faster processing and prevent pollution.

Examples of organic complex salts iron (III) which preferably be used because of its high belaching power include iron (III) complex salts of ethylenediaminetetraacetic acid, diethylenetriaminepentaacetic acid, cyclohexanediaminetetraacetic acid, 1,2-diaminopropanetetraacetic acid, methyliminodiacetic acid, 1,3-diaminopropanetetraacetic acid, and glycoletherdiaminetetraacetic acid.

Examples of persulfates which may preferably be used in the present invention include persulfates of alkali metals such as potassium persulfate and sodium persulfate, and ammonium persulfate.

The amount of the bleaching agent in 1 l of the bleaching solution is preferably in the range of from 0.1 to 2 mol. A suitable pH range for the bleaching solution is from 0.5 to 8.0 if a ferric ion complex salt is used, particularly from 4.0 to 7.0 if a ferric ion complex salt of aminocarboxylic acid, aminopolyphosphonic acid, phosphonocarboxylic acid, or organic phosphonic acid is used. If a persulfate is used, the concentration of the solution is from 0.1 to 2 mol/l and its pH value is preferably in the range of from 1 to 5.

As a suitable fixing agent for fixing or blix, any suitable known fixing agent may be used. Examples of such fixing agents include thiosulfates such as sodium thiosulfate and ammonium thiosulfate, thiocyanates such as sodium thiocyanate and ammonium thiocyanate, thioether compounds such as ethylenebisthioglycolic acid, and 3,6-dithia-1,8-octanediol, and water-soluble silver halide solvent such as thiourea. These compounds may be used singly or in admixture.

With regard to fixing or blix, the concentration of the fixing agent is preferably from 0.2 to 4 mol/l. In blix, the concentration of ferric ion complex salt and fixing agent are preferable from 0.1 to 2 mol and from 0.2 to 4 mol per 1 l of blix solution, respectively. The pH value of the fixing solution or blix solution is preferably in the range of from 4.0 to 9.0, particularly from 5.0 to 8.0.

Besides the above additives, the present fixing solution or blix solution may contain as a preservative a sulfite such as sodium sulfite, potassium sulfite, and ammonium sulfite, bisulfite, hydroxylamine, hydrazine, or bisulfite addition product of aldehyde compound such as sodium acetaldehyde bisulfite. The present fixing solution or blix solution may further contain various fluorescent brightening agents, antifoaming agents, surface active agents, and organic solvents such as polyvinyl pyrrolidone, and methanol.

The bleaching solution, blix solution and their prebaths may optionally comprise any suitable bleach accelerators. Specific examples of such useful bleach accelerators include compounds containing mercapto or disulfide groups, thiazolidine derivatives, thiourea derivatives, iodides, polyethyleneoxides, polyamines, compounds as described in Japanese Patent Application (OPI) Nos. 42434/74, 59644/74, 94927/78, 35727/79, 26506/80, and 163940/83, iodine ion, and bromine ion. Among these compounds, the compounds containing mercapto or disulfide groups are preferably used in light of its excellent effect of accelerating bleaching. In particular, compounds as described in U.S. Pat. No. 3,893,858, West German Pat. No. 1,290,812, and Japanese Patent Application (OPI) No. 95630/78 are preferably used. Furthermore, compounds as described in U.S. Pat. No. 4,552,834 are preferably used. These bleach accelerators may be incorporated in the light-sensitive material.

The fixing or blix process is generally followed by a processing step such as rinsing and stabilization.

In order to prevent precipitation or improve the stability of rinsing water, various known compounds may be incorporated in the rinsing and stabilizing process. Examples of such known compounds which may be optionally incorporated in these processing steps include chelating agents such as inorganic phosphoric acid, aminopolycarboxylic acid, and organic phosphonic acid, germicides or anti-fungal agents for inhibiting generation of various bacteria, molds or fungi such as compounds described in *Journal of Antibacterial and Antifungal Agents* (Vol. 11, No. 5, pp. 207 to 223, 1983) and compounds as described in *BOKIN BOBAI NO KAGAKU* (Antibacterial and antifungal chemistry) (edited by Hiroshi Horiguchi), metal salts such as magenta salts, aluminum salts, and ammonium salts, and surface active agents for preventing drying load and mark. Furthermore, compounds as described in *Photographic Science and Engineering* (Vol. 6, pp. 344 to 359, 1965) may be used. In particular, chelating agents, germicides or antifungal agents may be effectively used. The rinsing process is generally ultistage counterflow using two or more tanks (e.g., 2 to 9 tanks) to same rinsing water. The rinsing process can be replaced by a multistage counterflow stabilizing process as described in Japanese Patent Application (OPI) No. 8543/82. In order to stabilize image, the present stabilizing bath may comprise various compounds besides the above mentioned additives. Typical examples of such compounds include various buffers for adjusting the pH of the film (at e.g., 3 to 9) such as borate, metaborate, borax, phosphate, carbonate, potassium hydroxide, sodium hydroxide, ammonia water, monocarboxylic acid, dicarboxylic acid, polycarboxylic acid, combinations thereof, and aldehydes such as formalin. Other examples of such compounds include chelating agents such as inorganic phosphoric acid, aminocarboxylic acid, organic phosphonic acid, aminopolyphosphonic acid, and phosphonocarboxylic acid, germicides, antifungal agents such as a thiazole, isothiazole, halogenated phenol, sulfanylamide, and benzotriazole, surface active agents, florescent brightening agents, metal salts of film hardeners, and other various additives. Two or more compounds for the same or different purposes may be based in combination.

Various ammonium salts such as ammonium chloride, ammonium nitrate, ammonium sulfate, smmonium phosphate, ammonium sulfite, and ammonium thiosulfate may be preferably used as a pH adjustor for film which has been processed in order to improve image stability.

The present rinsing or stabilizing time depends on the type and processing conditions of the light-sensitive material to be processed. It is generally in the range of from 20 seconds to 10 minutes, preferably from 20 seconds to 5 minutes.

These various processing solutions of the present invention may be used at a temperature of from 10° to 50° C. The standard temperature is in the range of from 33° to 38° C. However, a higher temperature range can be used to accelerate processing so that processing time can be shortened. On the contrary, a lower temperature range can be used to improve picture quality of the stability of the processing solution.

Processing time can be shorter than the standard value by a safe amount if necessary to speed processing.

For a continuous processing step, fluctuation in solution composition can be prevented by using refill for each processing solution so that a constant finish can be provided.

The amount of refill to be used for each processing step is preferably as small as possible. The amount of refill is preferably 0.1 to 50 times, more preferably 3 to 30 times the amount of solution brought from prebath per unit area of light-sensitive material.

Each processing bath may optionally be provided with a heater, temperature sensor, liquid level sensor, circulating pump, filter, floating cover, and squeegee.

In the present invention, a direct positive color image formation process, characterized by processing the direct positive light-sensitive material according to the present invention by the light fogging process is a preferred method.

The present invention will be further illustrated in the following examples, but the present invention should not be construed as being limited thereto. Unless otherwise indicated herein, all parts, percents, ratios and the like are by weight.

EXAMPLE 1

(1) Preparation of the emulsion

Emulsion A

An aqueous solution of potassium bromide and an aqueous solution of silver nitrate were added at the same time to a gelatin aqueous solution containing 0.3 g of 3,4-dimethyl-1,3-thiazoline-2-thione per 1 mol of Ag with vigorous stirring at a temperature of 75° C. in about 20 minutes to obtain a monodispersed emulsion of octahedron particulate silver bromide having an average particle diameter of 0.4 μm. Sodium thiosulfate and chloroauric acid (tetrahydrate) were each added to the emulsion thus obtained in amounts of 6 mg per 1 mol of silver. The admixture was heated to a temperature of 75° C. for 80 minutes to achieve chemical sensitization.

The emulsion with the silver bromide particles thus obtained was further processed by 40 minutes under the same precipitation conditions as before to obtain further growth of the silver halide particles. As a result, a monodispersed core/shell emulsion of octahedron silver bromide having an average particle diameter of 0.7 μm was obtained.

After rinsing and desalting, sodium thiosulfate and chloroauric acid (tetrahydrate) were added to the emulsion thus obtained in amounts of 1.5 mg per 1 mol of silver. The admixture was heated to a temperature of 60° C. for 60 minutes to achieve chemical sensitization to obtain an internal latent image type silver halide emulsion A.

(2) Preparation of the photographic materials

The core/shell type internal latent image emulsion thus obtained was coated on a paper support having polyethylene laminated on both sides thereof to prepare the full color multilayer photographic paper specimens shown in Table 1. The coating solution was prepared as follows:

Preparation of a 1st layer containing solution 10 g of a cyan coupler (a) and 2.3 g of a dye stabilizer (b) were dissolved in 10 ml of ethyl acetate and 4 ml of a solvent (c). The resulting solution was emulsion-dispersed in 90 ml of a 10% gelatin aqueous solution containing 5 ml of 10% sodium dodecyl benzenesulfonate. On the other hand, the red-sensitive dye described below was added to the above mentioned silver halide emulsion (containing 70 g/kg of Ag) in an amopunt of $2.0\times10^{-4}$ mol per 1 mol of silver halide to prepare 90 g of a red-sensitive emulsion. The above emulsion dispersion and the emulsion thus obtained were mixed with a development accelerator (d). The concentration of the solution was then adjusted by addition of gelatin so that the composition shown in Table 1 was obtained. Furthermore, a nucleating agent and a nucleation accelerator were added to the solution in amounts of $4\times10^{-5}$ mol and $5\times10^{-4}$ mol per 1 mol of Ag, respectively, to prepare the 1st layer coating solution.

Preparation of coating solutions for 2nd to 7th layers

The coating solutions for the 2nd layer to the 7th layer were prepared in the same manner as in the coating solution for the 1st layer. As gelating hardener for each layer, the sodium salt of 1-oxy-3,5-dichloro-s-triazine was used.

As spectral sensitizer for each emulsion, compound mentioned below was used.

4-Hydroxy-6-methyl-1,3,3a,7-tetraazaindene was added to each of the emulsion layer.

TABLE 1

| Layer | Main component | Amount used |
|---|---|---|
| 7th layer (protective layer) | Gelatin | 1.33 g/m$^2$ |
| | Polymethylmethacrylate particle (size: 2.8 μm) | 0.05 g/m$^2$ |
| | Acryl-modified copolymer of polyvinyl alcohol (modification degree: 17%) | 0.17 g/m$^2$ |
| 6th layer (ultraviolet absorbing layer) | Gelatin | 0.54 g/m$^2$ |
| | Ultraviolet absorber (i) | $5.10\times10^{-4}$ mol/m$^2$ |
| | Solvent (k) | 0.08 g/m$^2$ |
| 5th layer (blue-sensitive layer) | Emulsion | 0.40 g/m$^2$ (in terms of amount of silver) |
| | Gelatin | 1.35 g/m$^2$ |
| | Yellow coupler (l) | $6.91\times10^{-4}$ mol/m$^2$ |
| | Dye stabilizer (m) | 0.13 g/m$^2$ |
| | Solvent (h) | 0.02 g/m$^2$ |
| | Development accelerator (d) | 32 mg/m$^2$ |
| | Nucleating agent and nucleation accelerator | |
| 4th layer (ultraviolet absorbing layer) | Gelatin | 1.60 g/m$^2$ |
| | Colloidal silver | 0.10 g/m$^2$ |
| | Ultraviolet absorber (i) | $1.70\times10^{-4}$ mol/m$^2$ |
| | Stain inhibitor (j) | $1.60\times10^{-4}$ mol/m$^2$ |
| | Solvent (k) | 0.24 g/m$^2$ |
| 3rd layer (green-sensitive layer) | Emulsion | 0.18 g/m$^2$ (in terms of amount of silver) |
| | Gelatin | 1.56 g/m$^2$ |
| | Magenta coupler (f) | $4.60\times10^{-1}$ mol/m$^2$ |
| | Dye stabilizer (g) | 0.14 g/m$^2$ |
| | Solvent (h) | 0.42 g/m$^2$ |
| | Development accelerator (d) | 32 mg/m$^2$ |
| | Nucleating agent and nucleation accelerator | |
| 2nd layer (Color stain inhibiting layer) | Gelatin | 0.90 g/m$^2$ |
| | Colloidal silver | 0.02 g/m$^2$ |
| | Color stain inhibitor (e) | $2.33\times10^{-4}$ mol/m$^2$ |
| 1st layer (red-sensitive layer) | Emulsion | 0.39 g/m$^2$ (in terms of amount of silver) |
| | Gelatin | 0.90 g/m$^2$ |
| | Cyan coupler (a) | $7.05\times10^{-4}$ mol/m$^2$ |
| | PMMA | 0.20 g/m$^2$ |
| | Dye stabilizer (b) | $5.20\times10^{-4}$ mol/m$^2$ |
| | Solvent 9c) | 0.22 g/m$^2$ |
| | Development accelerator (d) | 32 mg/m$^2$ |
| | Nucleating agent and nucleation accelerator | |

TABLE 1-continued

| Layer | Main component | Amount used |
|---|---|---|
| Support | Polyethylene-laminated paper (containing a white pigment ($TiO_2$, etc.) and a blue dye (ultramarine, etc.) in polyethylene on the 1st layer side (thickness: 100 μm)) | |
| 1st backing layer | Gelatin | 3.5 g/m$^2$ |
| 2nd backing layer | Gelatin | 0.8 g/m$^2$ |
| | Polymethylmethacrylate particles (size: 3.5 μm) | 0.05 g/m$^2$ |

Red-sensitive dye:

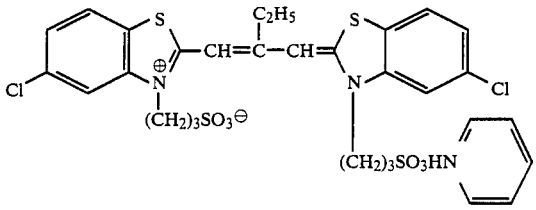

Green-sensitive dye:

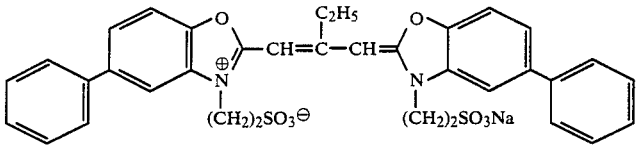

Blue-sensitive dye:

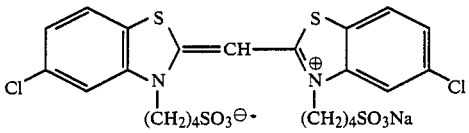

As anti-irradiation dyes, the following dyes were used:

Anti-irradiation dye for green-sensitive emulsion layer

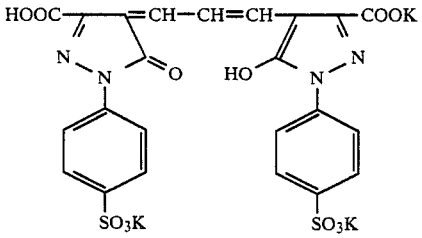

Anti-irradiation dye for red-sensitive emulsion layer

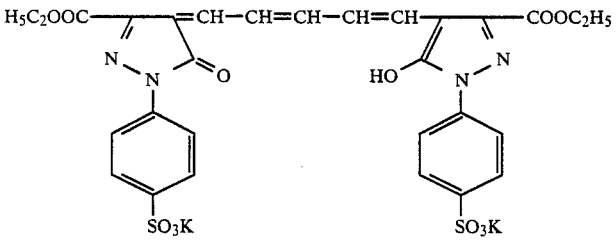

The structural formulae of the couplers and other compounds used in the present example are as follows:

Cyan coupler: (a)

-continued
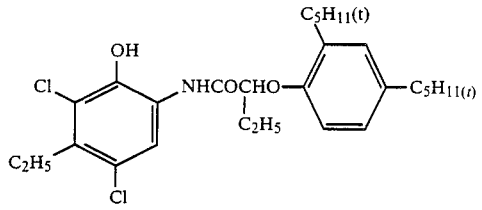
Dye Stabilizer (b)
1:3:3 mixture (molar ratio) of
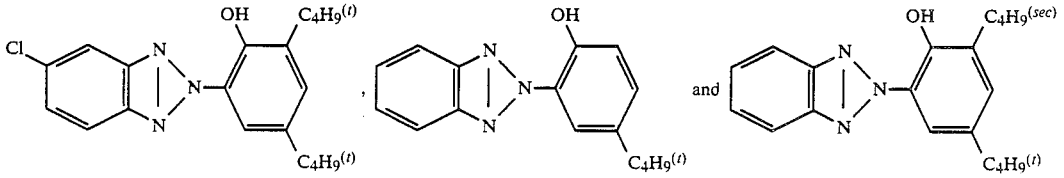
Solvent (c)
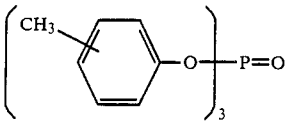
Development accelerator (d)
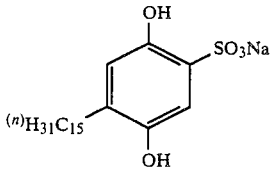
Color stain inhibitor (e)
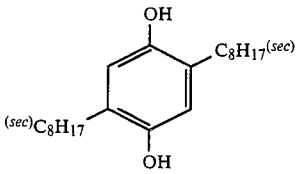
Magenta coupler (f)
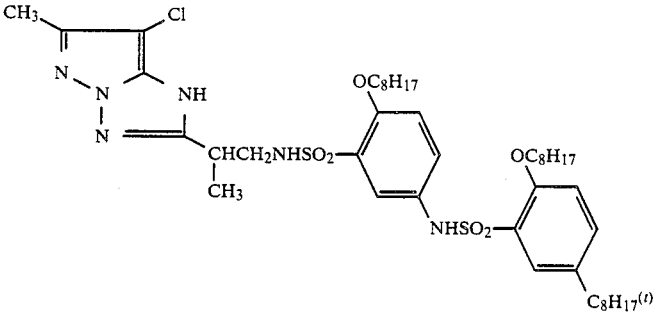
Dye stabilizer (g)
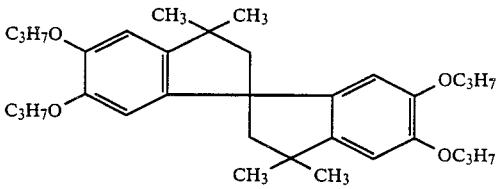
Solvent (h)
2:1 mixture (weight ratio) of
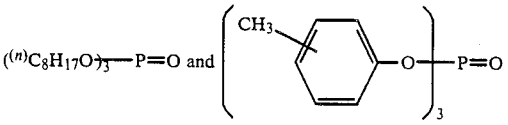
Ultraviolet absorber (i)
1:5:3 mixture (molar ratio of -continued

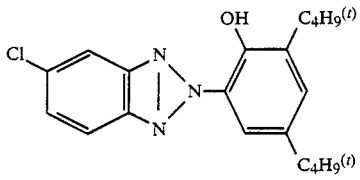
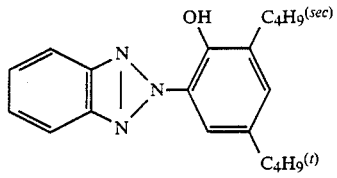
, and
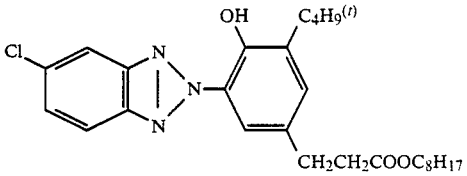

Color stain inhibitor (j)

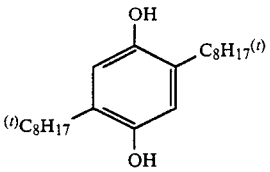

Solvent (iso $C_9H_{19}O)_3$—P=O (k)

Yellow coupler (l)

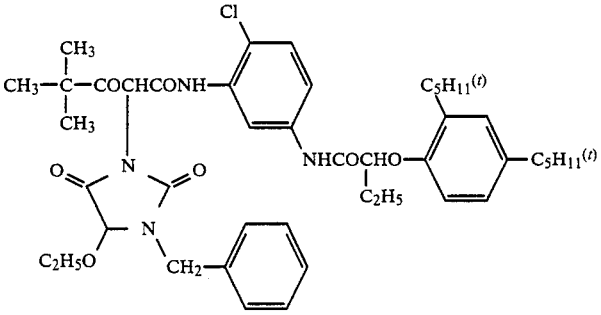

Dye stabilizer (m)

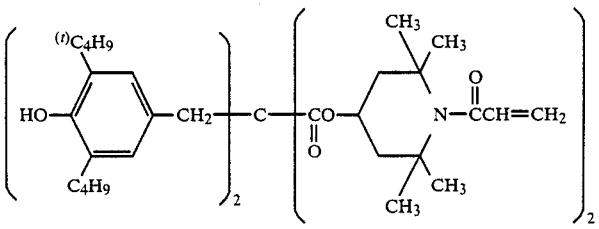

Nucleating agent

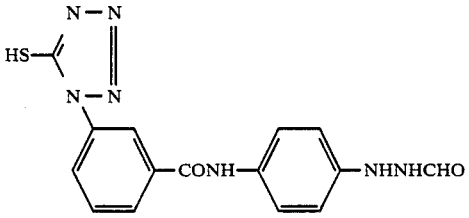

The coating solutions for the 1st layer to the 7th layer were adjusted for proper balance between surface tension and viscosity. These coating solutions were coated on a support at the same time to obtain a light-sensitive material referred to as comparative light-sensitive material a. Light-sensitive materials a-I to a-VIII of the present invention shown in Table 2 were then prepared in the same manner as in the above comparative light-sensitive material a except that DIR couplers (D-1) to (D-7) were incorporated in the layers shown in Table 2 in the form of a 3% emulsion with the respective coupler.

TABLE 2

| Light-sensitive Material | DIR Coupler | Layer in which DIR coupler is incorporated |
|---|---|---|
| a-I | D-1 | 5th layer (blue-sensitive layer) |
| a-II | D-2 | 5th layer (blue-sensitive layer) |
| a-III | D-3 | 3rd layer (green-sensitive layer) |
| a-IV | D-4 | 3rd layer (green-sensitive layer) |
| a-V | D-1 | 5th layer (blue-sensitive layer) |
| | D-3 | 3rd layer (green-sensitive layer) |
| a-VI | D-4 | 3rd layer (green-sensitive layer) |
| | D-6 | 1st layer (red-sensitive layer) |
| a-VII | D-6 | 1st layer (red-sensitive layer) |
| a-VIII | D-7 | 1st layer (red-sensitive layer) |

(D-1)

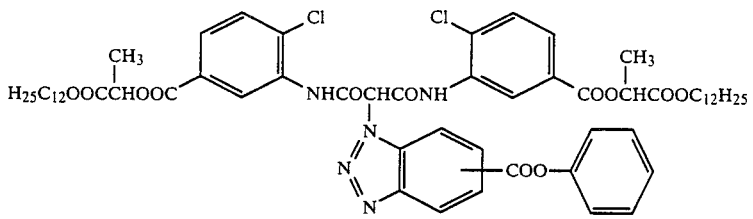

(D-2)

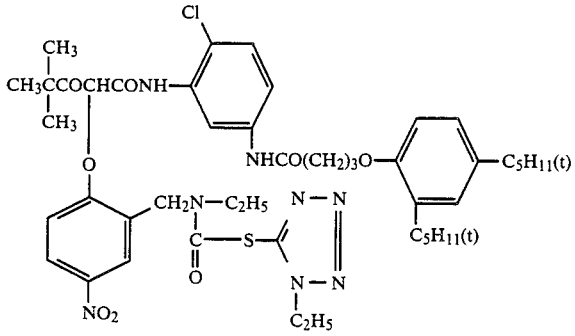

(D-3)

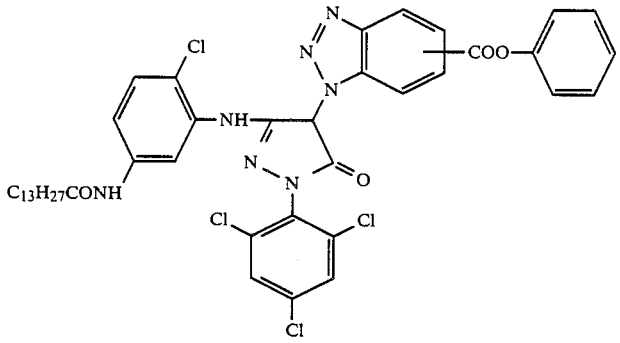

(D-4)

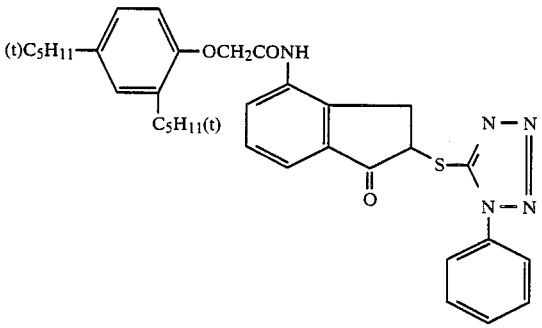

TABLE 2-continued (D-5)

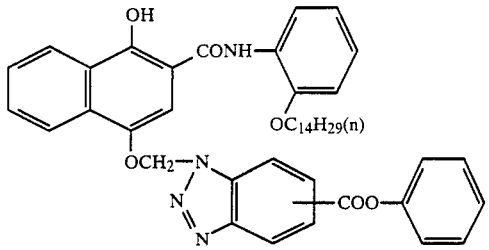

(D-6)

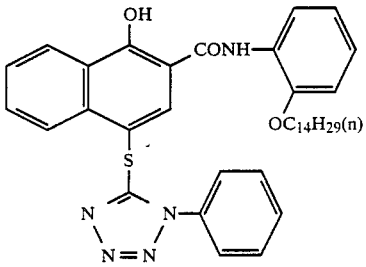

(D-7)

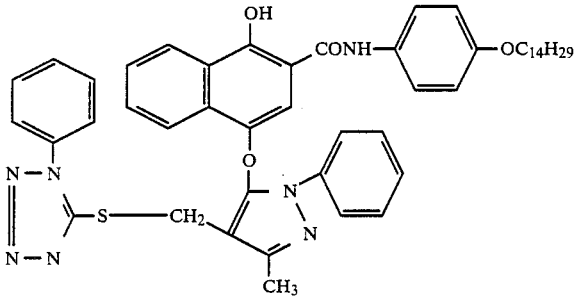

The 1st layer and the 3rd layer were coated on a support at the same time as green-sensitive layer and red-sensitive layer, respectively, to obtain a light-sensitive material referred to as comparative light-sensitive material a'. Light-sensitive materials a-IX to a-XI of the present invention were then prepared in the same manner as in the above comparative light-sensitive material a' except in that the above mentioned DIR couplers were incorporated in the layers shown in the table below in the form of a 3% emulsion with the respective coupler.

| Light-sensitive material | DIR coupler | Layer in which DIR coupler is incorporated |
|---|---|---|
| a-IX | D-5 | 3rd layer (red-sensitive layer) |
| a-X | D-7 | " |
| a-XI | D-6 | 3rd layer (red-sensitive layer) |
| | D-4 | 1st layer (green-sensitive layer) |

(3) Exposure to light and development

The light-sensitive material specimens thus prepared were then exposed to light under the following conditions:

Condition (a)

The light-sensitive material is exposed to light through Fuji Film's SC-50 Yellow Filter for 1/10 second (2CNS).

Condition (b)

The light-sensitive material is exposed to light through Fuji Film's SP-4 Magenta Filter for 1/10 second (2CMS).

Condition (c)

The light-sensitive material is exposed to light through Fuji Film's SP-5 Cyan Filter for 1/10 second (2CMS).

The light-sensitive material is exposed to light were then developed in the following processing step A (pH of color developing solution: 10.2), B (pH of color developing solution: 10.4) and C (pH of color developing solution: 10.0):

| | Processing Step A | |
|---|---|---|
| | Time | Temperature |
| Color development | 3 min. 30 sec. | 33° C. |
| Blix | 1 min. 30 sec. | " |
| Stabilizer 1 | 1 min. | " |
| 2 | 1 min. | " |
| 3 | 1 min. | " |

Replenishment of the stabilizing bath was effected in a so-called counterflow replenishing process. In this process, stabilizing bath 3 is first replenished. The overflow solution from stabilizing bath 3 is then introduced into stabilizing bath 2. The overflow solution from stabilizing bath 2 is introduced into stabilizing bath 1.

Processing steps B and C were each conducted in the same manner as in processing step A except that the pH value of the color developing solutions was adjusted to 10.4 and 10.0, respectively.

| Color developing solution | Mother solution |
|---|---|
| Diethylenetriaminepentaacetic acid | 2.0 g |
| Benzyl alcohol | 12.8 g |
| Diethylene glycol | 3.4 g |
| Sodium sulfite | 2.0 g |
| Sodium bromide | 0.26 g |
| Hydroxylamine sulfate | 2.60 g |
| Sodium chloride | 3.20 g |
| 3-Methyl-4-amino-N—ethyl-N—(β-methane-sulfonamidoethyl)aniline | 4.25 g |
| Potassium carbonate | 30.0 g |
| Fluorescent brightening agent (stilbene series) | 1.0 g |
| Water to make | 1,000 ml (pH 10.0 to 10.4) |

(The pH value of the solution was adjusted with potassium hydroxide or hydrochloric acid.)

| Blix solution | Mother liquor |
|---|---|
| Ammonium thiosulfate | 110 g |
| Sodium hydrogen sulfite | 10 g |
| Iron (III) ammonium diethylenetriamine pentaacetate (monohydrate) | 56 g |
| Disodium ethylenediaminetetraacetate (dihydrate) | 5 g |
| 3-Mercapto-1,3,4-triazole | 0.5 g |
| Water to make | 1,000 ml (pH 6.5) |

(The pH value of the solution was adjusted with ammonia water or hydrochloric acid.)

| Stabilizing solution | Mother liquor |
|---|---|
| 1-Hydroxyethylidene-1,1'-diphosphonic acid (60%) | 1.6 ml |
| Bismuth chloride | 0.35 g |
| Polyvinylpyrrolidone | 0.25 g |
| Ammonia water | 2.5 ml |
| Trisodium nitrilotriacetate | 1.0 g |
| 5-Chloro-2-methyl-4-isothiazoline-3-one | 50 mg |
| 2-Octyl-4-isothiazoline-3-one | 50 mg |
| Fluorescent brightening agent (4,4'-diaminostilbene series) | 1.0 g |
| Water to make | 1,000 ml (pH 7.5) |

(The pH value of the solution was adjusted with potassium hydroxide or hydrochloric acid.)

(4) Evaluation

The direct positive images thus obtained were measured for yellow color density, magenta color density, and cyan color density.

The results are shown in Tables 3 to 5.

TABLE 3

| | Yellow color density | | | | |
|---|---|---|---|---|---|
| | Light-sensitive | Conditions of exposure | Processing step | | |
| No. | material | to light | C | A | B |
| Comparative Example 1 | a | (a) | 1.70 | 1.95 | 2.10 |
| Comparative Example 2 | a' | (a) | 1.69 | 1.95 | 2.09 |
| Present invention 1 | a-III | (a) | 1.90 | 2.04 | 2.11 |
| Present invention 2 | a-IV | (a) | 1.89 | 2.02 | 2.09 |
| Present invention 3 | a-VI | (a) | 1.93 | 2.01 | 2.08 |
| Present | a-X | (a) | 1.97 | 2.00 | 2.04 |

TABLE 3-continued

| | Yellow color density | | | | |
|---|---|---|---|---|---|
| | Light-sensitive | Conditions of exposure | Processing step | | |
| No. | material | to light | C | A | B |
| invention 4 | | | | | |

The above table shows that the present light-sensitive materials a-III, a-IV, a-VI, and a-X have less fluctuation in the density of the yellow monocolor portion due to fluctuation in pH.

TABLE 4

| | Magenta color density | | | | |
|---|---|---|---|---|---|
| Example | Light-sensitive | Conditions of exposure | Processing step | | |
| No. | material | to light | C | A | B |
| Comparative Example 3 | a | (b) | 1.63 | 1.85 | 2.02 |
| Comparative Example 4 | a' | (b) | 1.51 | 1.74 | 1.88 |
| Present Invention 5 | a-I | (b) | 1.84 | 1.87 | 1.92 |
| Present Invention 6 | a-II | (b) | 1.86 | 1.91 | 1.95 |
| Present Invention 7 | a-IV | (b) | 1.78 | 1.80 | 1.83 |
| Present Invention 8 | a-X | (b) | 1.76 | 1.83 | 1.84 |

The above table shows that the present light-sensitive materials a-I, a-II, a-IX, and a-X have less fluctuation in the density of the magenta monocolor portion due to fluctuation in pH.

TABLE 5

| | Cyan color density | | | | |
|---|---|---|---|---|---|
| Example | Light-sensitive | Conditions of exposure | Processing step | | |
| No. | material | to light | C | A | B |
| Comparative Example 5 | a | (c) | 1.44 | 1.66 | 1.82 |
| Comparative Example 6 | a' | (c) | 1.54 | 1.78 | 1.94 |
| Present Invention 9 | a-III | (c) | 1.67 | 1.69 | 1.75 |
| Present Invention 10 | a-IV | (c) | 1.63 | 1.74 | 1.75 |
| Present Invention 11 | a-V | (c) | 1.70 | 1.77 | 1.78 |

The above table shows that the present light-sensitive materials have less fluctuation in the density of the cyan monocolor portion due to fluctuation in pH.

EXAMPLE 2

A comparative light-sensitive material b was prepared in the same manner as in the comparative light-sensitive material a' except in that the type and added amount of nucleating agent and nucleation accelerator contained therein was changed, the yellow coupler, magenta coupler and cyan coupler were replaced by the below mentioned compounds, and an emulsion of fine particles having a particle size of 0.07 μm was incorporated in the protective layer (7th layer) in an amount of 0.19 g/m$^2$.

Nucleating agent:

Nucleation accelerator:

-continued

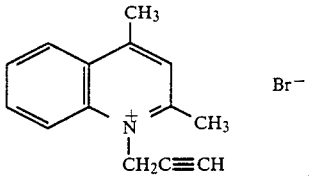

Added amount: $1 \times 10^{-4}$ mol/l Ag

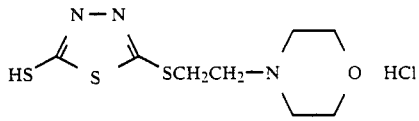

Added amount: $5 \times 10^{-4}$ mol/l mol Ag

Cyan coupler (a')

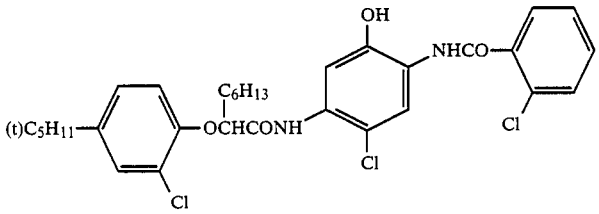

Magenta coupler (f')

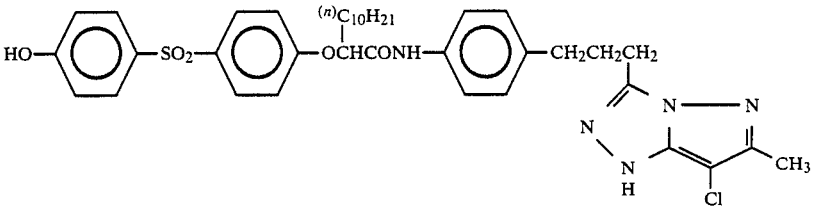

Yellow coupler (l')

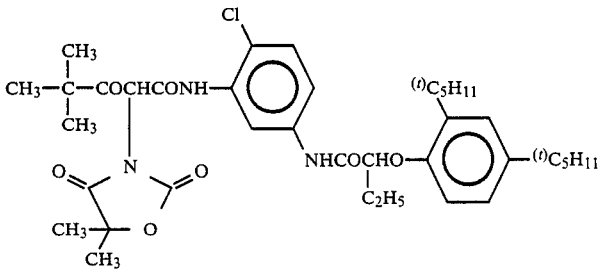

Light-sensitive materials b-I to b-VI were prepared in the same manner as in the comparative light-sensitive material b except in that DIR coupler (D-1) to (D-7) were incorporated in the layers shown in Table 6 in the form of a 3% emulsion with the respective main coupler.

TABLE 6

| Light-sensitive material | DIR coupler | Layer in which DIR coupler is incorporated |
|---|---|---|
| b-I | D-4 | 3rd layer (red-sensitive layer) |
| b-II | D-5 | " |
| b-III | D-6 | " |
| b-IV | D-7 | " |
| b-V | D-5 | 3rd layer (red-sensitive layer) |
| | D-3 | 1st layer (green-sensitive layer) |
| b-VI | D-6 | 3rd layer (red-sensitive layer) |
| | D-1 | 5th layer (blue-sensitive layer) |

The light-sensitive materials thus prepared were then exposed to light and evaluated in the same manner as in Example 1 except that they were subjected to the below mentioned processing step D. The results are shown in Tables 7 and 8.

| Processing step D | Time | Temperature |
|---|---|---|
| Color development | 2 min. 00 sec. | 35° C. |
| Blix | 1 min. 00 sec. | " |
| Rinsing 1 | 20 sec. | " |
| 2 | 20 sec. | " |
| 3 | 20 sec. | " |

The replenishment of the stabilizing bath was conducted in a so-called counterflow replenishing process. In this process, stabilizing bath 3 is first replenished. The overflow from stabilizing bath 3 is then introduced into stabilizing bath 2. The overflow from stabilizing bath 2 is introduced into stabilizing bath 1.

Processing steps E and F each are conducted in the same manner as in processing step D except that the pH value of the color developing solutions were adjusted to 10.4 and 10.0, respectively.

| Color developing solution | Mother solution |
|---|---|
| Diethylenetriaminepentaacetic acid | 2.0 g |
| Sodium sulfite | 0.3 g |
| Sodium bromide | 0.26 g |
| Diethylhydroxylamine | 4.0 g |
| 3-Methyl-4-amino-N—ethyl-N—(β-methane-sulfonamidoethyl)aniline | 5.0 g |
| Potassium carbonate | 30.0 g |
| Fluorescent brightening agent*1 | 3.0 g |
| Water to make | 1,000 ml (pH 10.0–10.4) |

(The pH value of the solution was adjusted with potassium hydroxide or hydrochloric acid.)

| Blix solution | Mother solution |
|---|---|
| Ammonium thiosulfate | 110 g |
| Sodium hydrogen sulfite | 10 g |
| Iron (III) ammonium ethylenediaminetetraacetate monohydrate | 56 g |
| Disodium ethylenediaminetetraacetate dihydrate | 10 g |
| Acetic acid (90%) | 12 cc |
| Water to make | 1,000 ml (pH 5.8) |

(The pH value of the solution was adjusted with ammonia water or hydrochloric acid.)

*1Fluorescent brightening agent

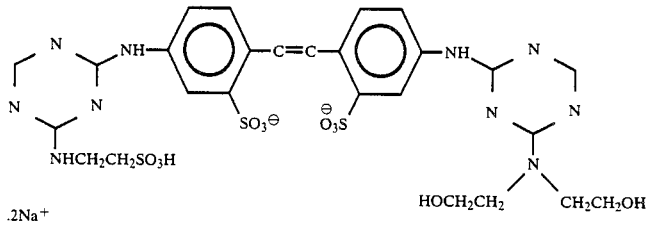

Rinsing

Tap water treated with sodium type cationic exchange resin SKIP (produced by Mitsubishi Chemical Industries, Ltd.) (calcium ion content: 1 ppm; magnesium ion content: 0.3 ppm) was used.

TABLE 7

| No. | Light-sensitive material | Conditions of exposure to light | Yellow color density: Processing step F | D | E |
|---|---|---|---|---|---|
| Comparative Example 6 | b | (a) | 1.74 | 2.06 | 2.26 |
| Comparative Example 12 | b-V | (a) | 1.95 | 2.10 | 2.19 |

TABLE 8

| No. | Light-sensitive material | Conditions of exposure to light | Magenta color density: Processing step F | D | E |
|---|---|---|---|---|---|
| Comparative Example 7 | b | (b) | 1.77 | 1.97 | 2.10 |
| Present Invention 13 | b-I | (b) | 2.06 | 2.07 | 2.11 |
| Present Invention 14 | b-II | (b) | 2.10 | 2.11 | 2.16 |
| Present Invention 15 | b-III | (b) | 1.97 | 2.07 | 2.11 |
| Present Invention 16 | b-IV | (b) | 1.98 | 2.03 | 2.05 |
| Present Invention 17 | b-V | (b) | 2.06 | 2.10 | 2.11 |

Table 8 shows that the present light-sensitive materials b-I to b-V have less fluctuation in the density of the magenta monocolor portion due to fluctuation in pH.

EXAMPLE 3

(1) Preparatin of Emulsion B 30 g of gelatin was dissolved in 1 l of a mixed solution containing 0.5 mol of KBr, 0.2 mol of NaCl, and 0.0015 mol of KI. 700 cc of a solution of 1 mol/l of silver nitrate was added to the mixed solution at a temperature of 60° C. in 20 minutes. The admixture was subjected to physical ripening for 20 minutes.

The admixture was then rinsed with water to remove water-soluble halides therefrom. 20 g of gelatin was added to the emulsion. Water was added to the mixture to make 1,200 cc. As a result, an emulsion of silver halide particles having an average particle diameter of 0.4 μm was obtained.

500 cc of a 1 mol/l aqueous solution of silver nitrate and 500 cc of a 2 mol/l aqueous solution of sodium chloride were added to 300 cc of the emulsion thus obtained at the same time at a temperature of 60° C. so that silver chloride shell was precipitated. The emulsion was then rinsed with water to obtain an emulsion of silver halide particles having an average particle diameter of 0.7 μm (Emulsion B).

(2) Preparation, exposure and development of light-sensitive materials

A comparative light-sensitive material c having the layer structure shown in Table 9 was prepared using Emulsion B instead of Emulsion A with no nucleating agent or nucleation accelerator contained therein.

TABLE 9

| Layer | Main component | Used amount |
|---|---|---|
| 7th layer (Protective layer) | Gelatin | 1.33 g/m$^2$ |
| | Acrylic-modified copolymer of polyvinyl alcohol (modification degree: 17%) | 0.17 g/m$^2$ |
| 6th layer (ultraviolet absorbing layer) | Gelatin | 0.54 g/m$^2$ |
| | Ultraviolet absorber (i) | $5.10 \times 10^{-4}$ mol/m$^2$ |
| | Solvent (k) | 0.08 g/m$^2$ |
| 5th layer (blue-sensitive layer) | Emulsion B | 0.40 g/m$^2$ (in terms of amount of silver) |
| | Gelatin | 1.35 g/m$^2$ |
| | Yellow coupler (l) | $6.91 \times 10^{-4}$ mol/m$^2$ |
| | Dye stabilizer (m) | 0.13 g/m$^2$ |
| | Solvent (h) | 0.02 g/m$^2$ |
| 4th layer (ultraviolet absorbing layer) | Gelatin | 1.60 g/m$^2$ |
| | Colloidal silver | 0.10 g/m$^2$ |
| | Ultraviolet absorber (i) | $1.70 \times 10^{-4}$ mol/m$^2$ |
| | Color stain inhibitor (j) | $1.60 \times 10^{-4}$ mol/m$^2$ |
| | Solvent (k) | 0.24 g/m$^2$ |
| 3rd layer (red-sensitive layer) | Emulsion B | 0.39 g/m$^2$ |
| | Gelatin | 0.90 g/m$^2$ |
| | Cyan coupler (a) | $7.05 \times 10^{-4}$ mol/m$^2$ |
| | Dye stabilizer (b) | $5.20 \times 10^{-4}$ mol/m$^2$ |
| | Solvent (c) | 0.22 g/m$^2$ |
| 2nd layer (color stain inhibiting layer) | Gelatin | 0.90 g/m$^2$ |
| | Colloidal silver | 0.02 g/m$^2$ |
| | Color stain inhibitor (e) | $2.33 \times 10^{-4}$ mol/m$^2$ |
| 1st layer (green-sensitive layer) | Emulsion B | 0.39 g/m$^2$ (in terms of amount of silver) |
| | Gelatin | 1.56 g/m$^2$ |
| | Magenta coupler (f) | $4.60 \times 10^{-4}$ mol/m$^2$ |
| | Dye stabilizer (g) | 0.14 g/m$^2$ |
| | Solvent (h) | 0.42 g/m$^2$ |
| Support | Polyethylene-laminated paper (containing a white pigment ($TiO_2$, etc.) and a blue dye (ultramarine, etc.) in polyethylene on the 1st layer side) | |

Red-sensitive dye:

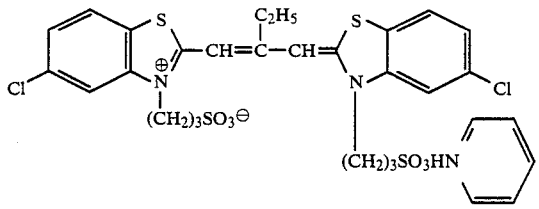

Green-sensitive dye:

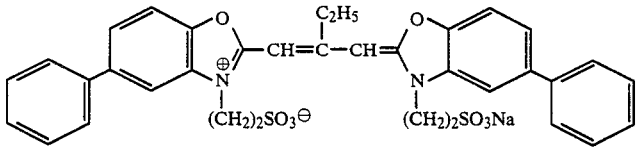

Blue-sensitive dye:

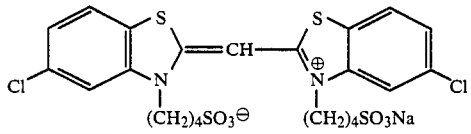

As anti-irradiation dyes, the following dyes were used.

Anti-irradiation dye for green-sensitive emulsion layer

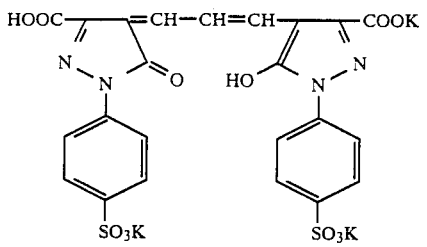
Anti-irradiation dye for red-sensitive emulsion layer
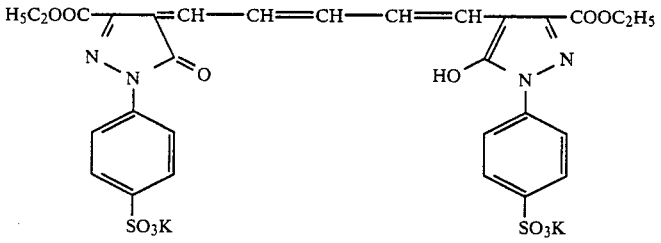
(a) Cyan coupler
1:1 mixture (molar ratio) of
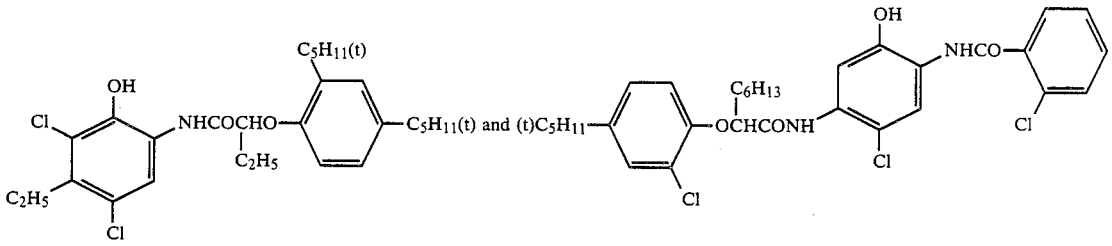
(b) Dye stabilizer
1:3:3 mixture (molar ratio) of
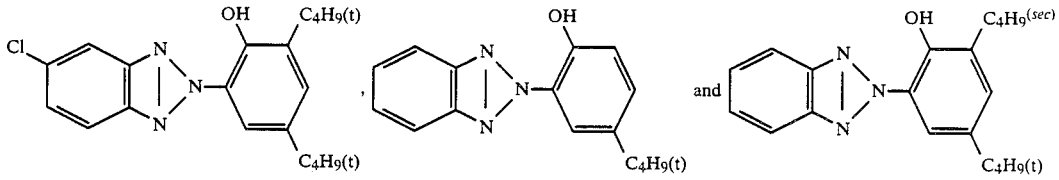
(c) Solvent
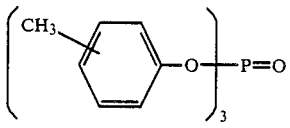
(d) Development accelerator
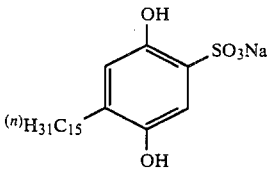
(e) Color stain inhibitor
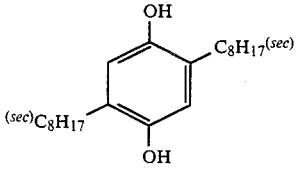
(f) Magenta coupler
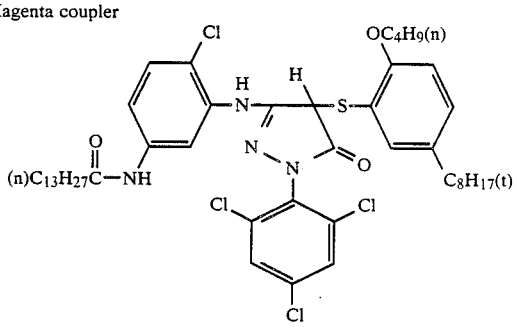

-continued
(g) Dye stabilizer
1:1.5 mixture (weight ratio) of
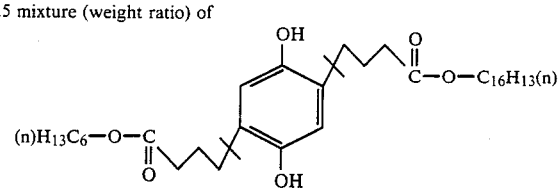
and
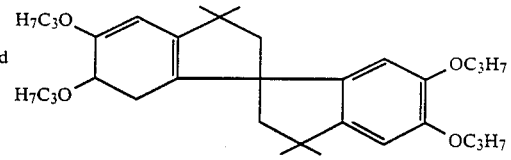
(h) Solvent
1:2:2 mixture (weight ratio) of
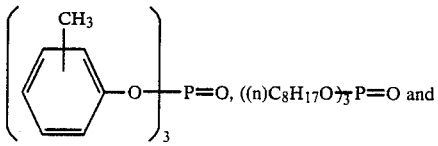
and
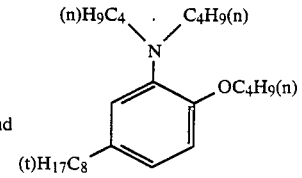
(i) Ultraviolet absorber
1:5:3 mixture (molar ratio) of
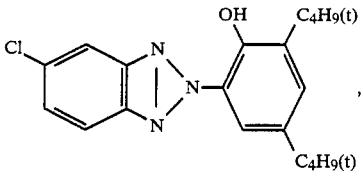
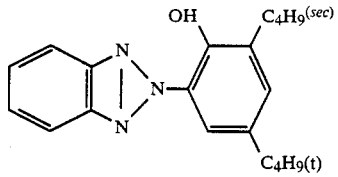
and
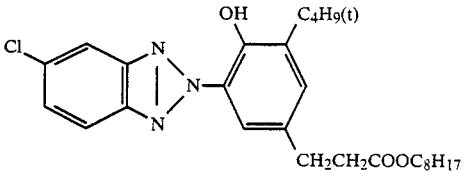
(j) color stain inhibitor
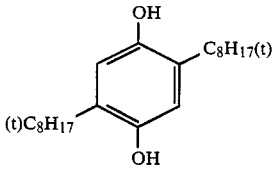
(k) Solvent
(iso $C_9H_{19}O)_3P{=}O$
(l) Yellow coupler
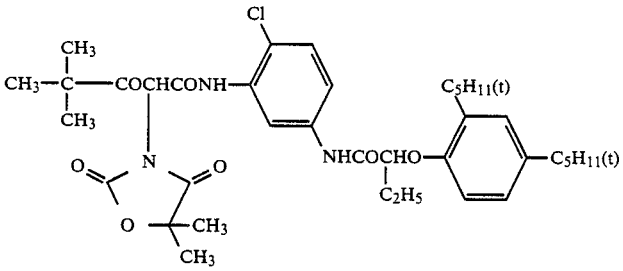
(m) Dye stabilizer
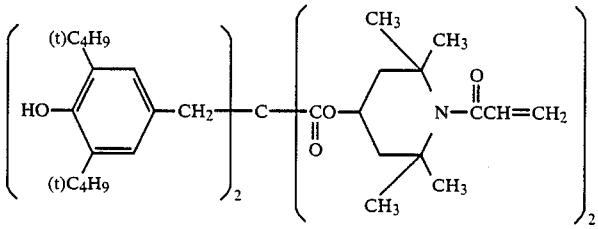

Light-sensitive materials c-I to c-VI of the present invention were prepared in the same manner as in the above comparative light-sensitive material c except that the DIR couplers (D-1) to (D-7) in Example 1 were incorporated in the layers shown in Table 10 in the form of a 4% emulsion with the respective main coupler.

TABLE 10

| Light-sensitive material | DIR coupler | Layer in which DIR coupler is incorporated |
|---|---|---|
| c-I | D-4 | 3rd layer (red-sensitive layer) |
| c-II | D-5 | 3rd layer (red-sensitive layer) |
| c-III | D-7, D-5 (molar ratio: 1:1) | 3rd layer (red-sensitive layer) |
| c-IV | D-5 | 3rd layer (red-sensitive layer) |
| | D-4 | 1st layer (green-sensitive layer) |
| c-V | D-2 | 5th layer (blue-sensitive layer) |
| | D-3 | 1st layer (green-sensitive layer) |
| c-VI | D-6 | 3rd layer (red-sensitive layer) |
| | D-1 | 5th layer (blue-sensitive layer) |

The light-sensitive materials thus obtained were subjected to exposure to light in the same manner as in Example 1 (Conditions (a), (b) and (c)), and then subjected to development (A, B and C). However, the light-sensitive materials were irradiated with 0.5 lux light (5,400° K.) on the surface thereof beginning 15 seconds after the beginning of development for 20 seconds. The resulting direct positive images were measured for magenta color density and cyan color density. The results are shown in Tables 11 to 13.

TABLE 11

| | Yellow color density | | | | |
|---|---|---|---|---|---|
| | Light-sensitive | Conditions of exposure | Processing step | | |
| No. | material | to light | C | A | B |
| Comparative Example 8 | c | (a) | 2.05 | 2.32 | 2.57 |
| Present Invention 18 | c-I | (a) | 2.40 | 2.45 | 2.60 |
| Present Invention 19 | c-IV | (a) | 2.44 | 2.46 | 2.53 |

TABLE 12

| | Magenta color density | | | | |
|---|---|---|---|---|---|
| | Light-sensitive | Conditions of exposure | Processing step | | |
| No. | material | to light | C | A | B |
| Comparative Example 9 | c | (b) | 1.36 | 1.77 | 1.99 |
| Present Invention 20 | c-I | (b) | 1.80 | 1.99 | 2.00 |
| Present Invention 21 | c-II | (b) | 1.70 | 1.95 | 1.99 |
| Present Invention 22 | c-III | (b) | 1.70 | 1.80 | 1.90 |
| Present Invention 23 | c-V | (b) | 1.77 | 1.80 | 1.85 |

TABLE 13

| | Cyan color density | | | | |
|---|---|---|---|---|---|
| | Light-sensitive | Conditions of exposure | Processing step | | |
| No. | material | to light | C | A | B |
| Comparative Example 10 | c | (c) | 1.54 | 1.78 | 1.94 |
| Present Invention 24 | c-V | (c) | 1.81 | 1.84 | 1.90 |

Table 13 shows that the present light-sensitive materials c-I to c-VI have less fluctuation in the density of the monocolor portion due to fluctuation in pH.

EXAMPLE 4

A comparative light-sensitive material d was prepared in the same manner as in Example 3 except that the 1st layer was made a red-sensitive layer and the 3rd layer was made a green-sensitive layer, and the yyellow, magenta, and cyan couplers were replaced by the couplers (a'), (f'), and (l') in Example 2, respectively.

Light-sensitive material d-I to d-IV of the present invention were prepared in the same manner as in the comparative light-sensitive material c except that the DIR couplers (D-1) to (D-7) in Example 1 were incorporated in the layers shown in Table 14 in the form of a 4% emulsion with the respective main coupler.

TABLE 14

| Light-sensitive material | DIR coupler | Layer in which DIR coupler is incorporated |
|---|---|---|
| d-I | D-1 | 5th layer (blue-sensitive layer) |
| d-II | D-3 | 3rd layer (green-sensitive layer) |
| d-III | D-4 | 3rd layer (green-sensitive layer) |
| d-IV | D-5 | 1st layer (red-sensitive layer) |

These specimens were then subjected to exposure, processing, and evaluation in the same manner as in Example 3. The results are shown in Tables 15 to 16.

TABLE 15

| | Magenta color density | | | | |
|---|---|---|---|---|---|
| | Light-sensitive | Conditions of exposure | Processing step | | |
| No. | material | to light | C | A | B |
| Comparative Example 11 | d | (b) | 2.08 | 2.50 | 2.71 |
| Present Invention 25 | d-I | (b) | 2.41 | 2.51 | 2.70 |
| Present Invention 26 | d-IV | (b) | 2.35 | 2.52 | 2.61 |

TABLE 16

| | Yellow color density | | | | |
|---|---|---|---|---|---|
| | Light-sensitive | Conditions of exposure | Processing step | | |
| No. | material | to light | C | A | B |
| Comparative Example 12 | d | (a) | 1.89 | 2.20 | 2.40 |
| Present Invention 27 | d-II | (a) | 2.10 | 2.30 | 2.41 |
| Present Invention 28 | d-III | (a) | 2.20 | 2.25 | 2.35 |

Table 16 shows that the present light-sensitive materials d-I to d-IV have less fluctuation in the density of monocolor portion due to fluctuation in pH.

In accordance with the present invention, an internal latent image type silver halide photographic material which has not been previously fogged is processed with a low pH color developing solution in the presence of a nucleating agent or under a light fogging process. In this manner, a direct positive color image with a high maximum color density and a low minimum image density can be rapidly and stably provided. At the same time, a stable direct positive color image which is less subject to fluctuation in maximum image density and minimum image density from optimum value due to fluctuation in temperature and pH of the color developing solution during running the development process or the like can be provided.

Furthermore, the developing solution to be used in the development of the present light-sensitive material is less subject to air oxidation and thus is stable.

While the invention has been described in detail and with reference to specific embodiments thereof, it will be apparent to one skilled in the art that various changes and modifications can be made therein without depending from the spirit and scope thereof.

What is claimed is:

1. A direct positive color light-sensitive material comprising a support having provided thereon at least one photographic emulsion layer containing unfogged internal latent image type silver halide particles and a color image forming coupler, wherein said color image forming coupler itself is substantially nondiffusible and produces or releases a dye upon oxidation coupling with a color developing agent, and said light-sensitive material contains at least one development inhibitor-releasing type coupler selected from the group consisting of compounds represented by formulae (D-I) and (D-II)

Coup—Z (D-I)

Coup—TIME—Z (D-II)

wherein coup represents a coupler residual group; Z represents a diffusible development inhibitor or a precursor thereof; and TIME represents a timing group, which further comprises a pyrazoloazole coupler.

2. A direct positive color light-sensitive material as in claim 1, wherein said development inhibitor or precursor thereof represented by Z is mercaptotetrazole, selenotetrazole, mercaptobenzothiazole, selenobenzothiazole, mercaptobenzoxazole, selenobenzoxazole, mercaptobenzimidazole, selenobenzimidazole, benzotriazole, benzodiazole, and derivatives or precursors thereof.

3. A direct positive color light-sensitive material as in claim 1, wherein the amount of said development inhibitor-releasing type coupler is in the range of from $1\times10^{-6}$ to $1\times10^{-1}$ mol per mol of silver halide.

4. A direct positive color light-sensitive material as in claim 3, wherein the amount of said development inhibitor-releasing type coupler is in the range of from $5\times10^{-5}$ to $5\times10^{-2}$ mol per mol of silver halide.

5. A direct positive color light-sensitive material as in claim 1, which further comprises a nucleating agent.

6. A direct positive color light-sensitive material as in claim 5, wherein the amount of said nucleating agent is in the range of from $1\times10^{-8}$ to $1\times10^{-2}$ mol per mol of silver halide.

7. A direct positive color light-sensitive material as in claim 6, wherein the amount of said nucleating agent is in the range of from $1\times10^{-6}$ to $1\times10^{-3}$ mol per mol of silver halide.

8. A direct positive color light-sensitive material as in claim 5, wherein said nucleating agent is represented by formula (N-I)

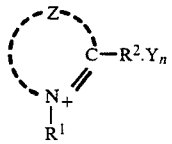

(N-I)

wherein Z represents a nonmetallic atomic group required to form a substituted or unsubstituted five- or six-membered heterocyclic ring; $R^1$ represents a substituted or unsubstituted aliphatic group; $R^2$ represents a hydrogen atom, a substituted or unsubstituted aliphatic group, or a substituted or unsubstituted aromatic group; Y represents a paired ion for electric charge balance; and n and m each represents an integer of 0 or 1, with the proviso that at least one of the groups represented by $R^1$, $R^2$, and Z contains an alkynyl group, an acyl group, a hydrazine group, or a hydrazone group or $R^1$ and $R^2$ combine to form a six-membered ring to provide a dihydropyridinium skeleton.

9. A direct positive color light-sensitive material as in claim 8, wherein at least one of the substituents for $R^1$, $R^2$, and Z contains $X^1$-$(L^1)_m$ in which $X^1$ represents a group accelerating adsorption to silver halide, and $L^1$ represents a divalent linkage group.

10. A direct positive color light-sensitive material as in claim 5, wherein said nucleating agent is represented by formula (N-II)

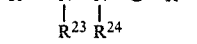

(N-II)

wherein $R^{21}$ represents an aliphatic group, an aromatic group, or a heterocyclic group; $R^{22}$ represents a hydrogen atom, an alkyl group, an aralkyl group, an aryl group, an alkoxy group, an aryloxy group, or an amino group; G represents a carbonyl group, a sulfonyl group, a sulfoxy group, a phospholyl group, or an iminomethylene group; and $R^{23}$ and $R^{24}$ each represents a hydrogen atom or one of $R^{23}$ and $R^{24}$ represents a hydrogen atom and the other represents an alkylsulfonyl group, an arylsulfonyl group, or an acyl group.

11. A direct positive color light-sensitive material as in claim 10, wherein G, $R^{23}$, $R^{24}$, and a nitrogen atom in hydrazine combine to form a hydrazone structure.

12. A direct positive color image formation process comprising processing a direct positive color light-sensitive material by a light fogging process, wherein said direct positive light-sensitive material comprises a support having provided thereon at least one photographic emulsion layer containing unfogged internal latent image type silver halide particles and a color image forming coupler, wherein said color image forming coupler itself is substantially nondiffusible and produces or releases a dye upon oxidation coupling with a color developing agent, and said light-sensitive material contains at least one development inhibitor-releasing type coupler selected from the group consisting of compounds represented by formula (D-I) and (D-II)

Coup—Z (D-I)

Coup—TIME—Z (D-II)

wherein Coup represents a coupler residual group; Z represents a diffusible development inhibitor or a precursor thereof; and TIME represents a timing group, which further comprises a pyrazoloazole coupler.

13. A direct positive color image formation process as in claim 12, which comprises processing said direct positive light-sensitive material with a color developing solution having a pH value of from 9.5 to 11.3.

14. A direct positive color image formation process as in claim 13, which comprises processing said direct positive light-sensitive material with a color developing solution having a pH value of from 10.0 to 11.0.

15. A direct positive color light-sensitive material as in claim 1, wherein said pyrazoloazole coupler is [5,1-c] [1,2,4] triazole.

16. A direct positive color light-sensitive material as in claim 1, wherein said pyrazoloazole coupler is [1,5-b] [1,2,4] triazole.

17. A direct positive color image formation process as in claim 12, wherein said pyrazoloazole coupler is [5,1-c] [1,2,4] triazole.

18. A direct positive color image formation process as in claim 12, wherein said pyrazoloazole coupler is [1,5-b] [1,2,4] triazole.

* * * * *